US006585933B1

(12) United States Patent
Ehrhardt et al.

(10) Patent No.: US 6,585,933 B1
(45) Date of Patent: Jul. 1, 2003

(54) METHOD AND COMPOSITION FOR INHIBITING CORROSION IN AQUEOUS SYSTEMS

(75) Inventors: William C. Ehrhardt, Hamilton, NJ (US); Longchun Cheng, Hopewell Township, NJ (US); Dawn Stasney, Aston, PA (US); Kim A. Whitaker, Limerick, PA (US)

(73) Assignee: BetzDearborn, Inc., Trevose, PA (US)

( * ) Notice: Subject to any disclaimer, the term of this patent is extended or adjusted under 35 U.S.C. 154(b) by 0 days.

(21) Appl. No.: 09/303,596

(22) Filed: May 3, 1999

(51) Int. Cl.[7] ..... C23F 11/10

(52) U.S. Cl. ..... 422/16; 422/11; 422/12; 252/180; 252/390; 252/394; 252/395; 252/396

(58) Field of Search ..... 252/180, 390, 252/394, 395, 396; 210/699, 701; 422/11, 12, 16

(56) References Cited

U.S. PATENT DOCUMENTS

| | | | |
|---|---|---|---|
| 3,574,132 A | 4/1971 | Mosier et al. | 252/316 |
| 3,619,347 A | 11/1971 | Ireland, Jr. | |
| 3,779,931 A | 12/1973 | Fries et al. | |
| 3,860,464 A | 1/1975 | Erdman et al. | |
| 3,867,259 A | 2/1975 | Forgione | |
| 4,088,678 A | 5/1978 | Matt et al. | |

(List continued on next page.)

FOREIGN PATENT DOCUMENTS

| | | |
|---|---|---|
| DE | 4218585 | 9/1993 |
| EP | 0237738 | 9/1987 |

(List continued on next page.)

OTHER PUBLICATIONS

An abstract of DE 4218585.

Mostafa, Corrosion Prevention & Control, vol. 35, No. 3, 1988, pp. 70–72.

(List continued on next page.)

*Primary Examiner*—Jill Warden
*Assistant Examiner*—LaToya I Cross
(74) *Attorney, Agent, or Firm*—Steven D. Boyd

(57) ABSTRACT

A method and composition for controlling corrosion of metals, particularly ferrous-based metals in contact with aqueous systems is disclosed, which includes treating industrial waters with a combination of a tetrazolium salt of the general formula:

Figure 1:
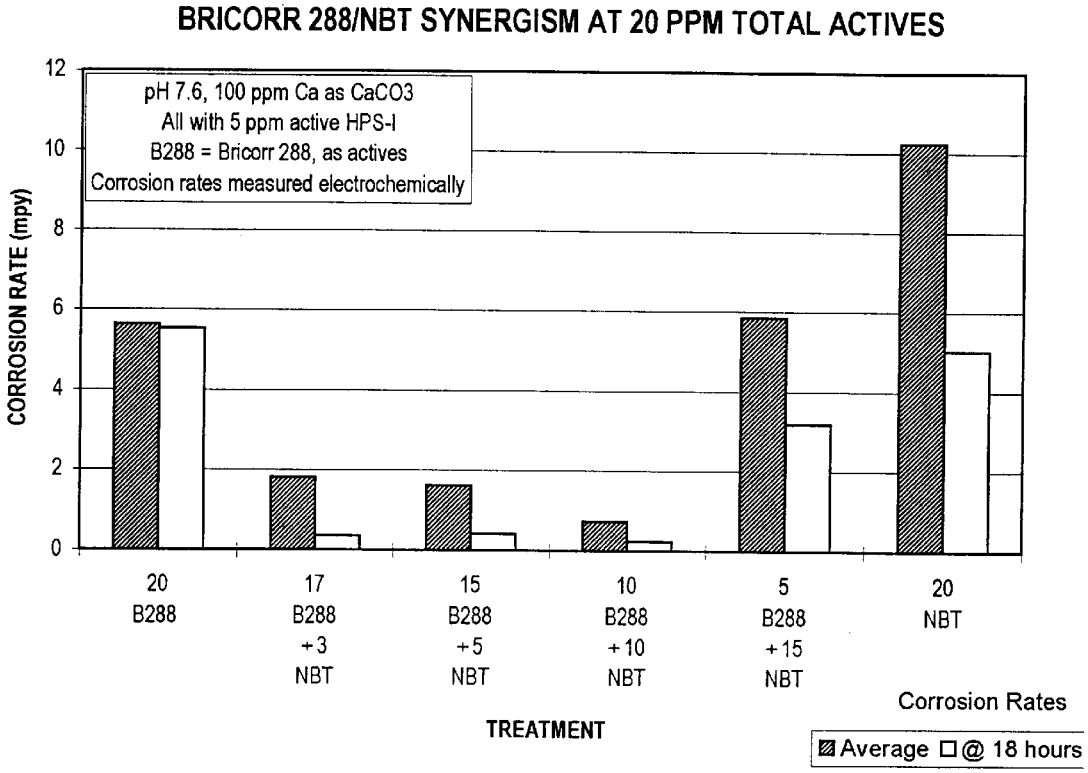

where $R_1$, $R_2$ and $R_3$ may be various organic or inorganic substitutents, where n may be 1 or 2, and at least one other aqueous system treatment material.

162 Claims, 1 Drawing Sheet

U.S. PATENT DOCUMENTS 4,101,441 A 7/1978 Hwa et al.
4,105,551 A 8/1978 Smith et al.
4,127,483 A 11/1978 Smith et al.
4,132,572 A 1/1979 Parant et al.
4,159,946 A 7/1979 Smith et al.
4,163,733 A 8/1979 Buckman et al.
4,207,405 A 6/1980 Masler, III et al.
4,220,153 A 9/1980 Dresback
4,239,648 A 12/1980 Marshall et al.
4,246,030 A 1/1981 Lipinski
4,246,103 A 1/1981 Block et al.
4,289,636 A 9/1981 Davis et al.
4,298,568 A 11/1981 Gerhardt et al.
4,307,038 A 12/1981 Sommer et al.
4,308,147 A 12/1981 Sommer et al.
4,369,079 A 1/1983 Shaw
4,402,839 A 9/1983 Davis et al.
4,402,907 A 9/1983 Clark
4,404,114 A 9/1983 Mohr et al.
4,405,426 A 9/1983 Hosoi et al.
4,409,121 A 10/1983 Latos et al. ..... 252/389
4,425,248 A 1/1984 Piotrowski et al.
4,563,284 A 1/1986 Amjad
4,613,450 A 9/1986 Moran et al.
4,617,129 A 10/1986 Lees
4,621,127 A 11/1986 Denzinger et al.
4,636,321 A 1/1987 Kipp et al.
4,640,818 A 2/1987 Grierson et al.
4,648,043 A 3/1987 O'Leary
4,659,459 A 4/1987 O'Leary et al.
4,681,686 A 7/1987 Richardson et al.
4,683,035 A 7/1987 Hunt et al.
4,689,200 A 8/1987 Cook et al.
4,728,452 A 3/1988 Hansen
4,732,905 A 3/1988 Donofrio et al.
4,734,257 A 3/1988 Penninger
4,744,950 A 5/1988 Hollander
4,749,550 A 6/1988 Goldie et al.
4,758,312 A 7/1988 Hunt et al.
4,758,359 A 7/1988 Kirk et al.
4,783,314 A 11/1988 Hoots et al.
4,847,017 A 7/1989 Clubley et al.
4,874,579 A 10/1989 Schmid et al.
4,895,668 A 1/1990 Singh et al.
4,897,797 A 1/1990 Free, Jr. et al.
4,957,704 A 9/1990 Dohner
4,966,711 A 10/1990 Hoots et al.
4,971,724 A 11/1990 Kalota et al.
5,000,866 A * 3/1991 Woyciesjes ..... 252/390
5,002,697 A 3/1991 Crucil et al.
5,023,000 A 6/1991 Kneller et al.
5,051,532 A 9/1991 Hwa et al.
5,055,230 A 10/1991 Clubley et al.
5,056,036 A 10/1991 Van Bork
5,062,962 A 11/1991 Brown et al.
5,073,299 A 12/1991 Cook
5,077,361 A 12/1991 Hughes et al.
5,085,794 A 2/1992 Kneller et al.
5,092,739 A 3/1992 Gill
5,096,595 A 3/1992 Hwa et al.
5,096,718 A 3/1992 Ayres et al.
5,130,052 A 7/1992 Kreh et al.
5,137,657 A 8/1992 Boffardi
5,141,675 A 8/1992 Vanderpool et al.
5,156,769 A 10/1992 Cha et al.
5,160,630 A 11/1992 Clubley et al.
5,167,866 A 12/1992 Hwa et al.
5,171,450 A 12/1992 Hoots
5,182,028 A 1/1993 Boffardi et al.
5,183,590 A 2/1993 Carter et al.
5,216,099 A 6/1993 Hughes et al.
5,217,686 A 6/1993 Vanderpool et al.
5,229,030 A 7/1993 Clubley et al.
5,236,626 A 8/1993 Vanderpool et al.
5,240,956 A 8/1993 Kirschenheuter et al.
5,242,602 A 9/1993 Richardson et al.
5,256,302 A 10/1993 Perez et al.
5,256,332 A 10/1993 Kessler
5,256,746 A 10/1993 Blankenship et al.
5,260,061 A 11/1993 Ayres et al.
5,262,078 A 11/1993 Hirozawa et al.
5,269,957 A 12/1993 Ikeda et al. ..... 252/86
5,275,744 A 1/1994 Ho
5,294,687 A 3/1994 Blankenship et al.
5,300,247 A 4/1994 Emerich et al.
5,314,910 A 5/1994 Kirschenheuter et al.
5,316,774 A 5/1994 Eury et al.
5,322,636 A 6/1994 Schaper
5,338,477 A 8/1994 Chen et al.
5,344,590 A 9/1994 Carter
5,360,550 A 11/1994 Clubley et al.
5,364,627 A 11/1994 Song
5,376,731 A 12/1994 Kerr et al.
5,386,038 A 1/1995 Davis et al.
5,391,369 A 2/1995 Roe et al.
5,401,428 A 3/1995 Kalota et al.
5,409,571 A 4/1995 Togo et al.
5,411,889 A 5/1995 Hoots et al.
5,425,914 A 6/1995 Brown et al.
5,489,666 A 2/1996 Carey et al.
5,503,775 A 4/1996 Rao et al.
5,531,934 A 7/1996 Freeman et al.
5,534,624 A 7/1996 Lesmann et al.
5,547,595 A 8/1996 Hacias
5,567,354 A 10/1996 Schwendimann et al.
5,578,246 A 11/1996 Beardwood
5,589,106 A 12/1996 Shim et al.
5,606,105 A 2/1997 Davis et al.
5,610,068 A 3/1997 Stuart et al.
5,611,991 A 3/1997 Naraghi
5,616,544 A 4/1997 Kalota et al.
5,629,385 A 5/1997 Kuo
5,635,484 A 6/1997 Ayres et al.
5,647,995 A 7/1997 Kneller et al.
5,653,695 A 8/1997 Hopkins et al.
5,654,198 A 8/1997 Carrier et al.
5,681,479 A 10/1997 Kerr et al.
5,695,092 A 12/1997 Schrandt
5,716,917 A 2/1998 Williams et al.
5,744,069 A 4/1998 Maeda et al.
5,750,070 A 5/1998 Tang et al.
5,772,919 A 6/1998 Reichgott et al.
5,779,938 A 7/1998 Naraghi et al.
5,783,728 A 7/1998 Kneller et al.
5,785,896 A 7/1998 Rother et al.
5,788,857 A 8/1998 Yang et al.
5,827,808 A 10/1998 Appleby et al.
5,855,791 A 1/1999 Hays et al.
5,863,463 A 1/1999 Reichgott et al.
5,863,464 A 1/1999 Reichgott et al.
5,866,032 A * 2/1999 Carey et al. ..... 252/180
5,871,691 A 2/1999 Carey et al.
5,993,852 A 11/1999 Foldvari et al.

FOREIGN PATENT DOCUMENTS

EP 283191 9/1988
EP 360746 3/1990
EP 0484949 5/1992
EP 569731 11/1993
EP 681995 11/1995
EP 792890 9/1997

| | | |
|---|---|---|
| EP | 807635 | 11/1997 |
| EP | 807654 | 11/1997 |
| EP | 861846 | 9/1998 |
| WO | 96/11291 | 4/1996 |
| WO | 96/33953 | 10/1996 |
| WO | 99/11247 | 3/1999 |
| WO | 00/11239 | 3/2000 |

OTHER PUBLICATIONS

El–Khair et al., Corrosion Prevention & Control, vol. 28, No. 4, 1981, pp. 7–10.

Gulil et al., Corrosion Prevention & Control, vol. 34, No. 6, 1987, pp. 149–151 and 159.

Marignier et al.,Journal de chimie physique, vol. 85, No. 1, 1988, pp. 21–28.

Abdel–Wahab et al., Asian J. Chem., vol. 5, No. 4, pp. 1084–1090, 1993.

C.C. Nathan, ed., *Corrosion Inhibitors*, NACE, 1973—Table of Contents.

Stone, Metals Handbook, 9th Ed., vol. 13, 1987—*Corrosion*, pp. 478–484.

Scattergood, Metals Handbook, 9th Ed., vol. 13, 1987—*Corrosion*, pp. 485–486.

Boffardi, Metals Handbook, 9th Ed., vol. 13, 1987—*Corrosion*, pp. 487–497.

B.G. Clubley, ed, *Corrosion Inhibitors for Corrosion Control*, Special Publication No. 71, The Royal Society of Chemistry, 1990 –Table of Contents.

*Corrosion Inhibitors*, European Federation of Corrosion Publications, No. 11, The Institute of Materials, 1994—Table of Contents.

L.L. Sheir, R.A. Jarman, and G.T. Burstein, eds., Corrosion, vol. 2—*Corrosion Control*, Butterworth–Heinemann, 1994, pp. 17:10–17:39.

Y.I. Kuznetsov, *Organic Inhibitors of Corrosion of Metals*, Plenum Press, 1996 Table of Contents.

V.S. Sastri, *Corrosion Inhibitors: Principles and Applications*, John Wiley & Sons, 1998– Table of Contents and pp. 567–585, 599–611, 644–689, 704–737, 764–787 and 846–853 (which include Chapters 9, 11, 15.1, 15.2, 15.4, 15.5, 15.7 and 15.11).

English Language Abstract of DE 42 18 585.

Database Compendex Online! Engineering Information, Inc., New York, NY, US, Gulil et al., "Inhibition of Acid Corrosion of Ni With 2,3,5–Triphenyltetrazolium Chloride", Database Accession No. EIX88050068999, XP002144272. Abstract.

Abo El–Khair et al., "Inhibiting Effect of Triphenyl Tetrazolium Chloride on the Corrosion of Aluminum in HCL", Corrosion Prevention and Control, 1981, pp. 7–10.

Ateya et al., "Inhibition of the Acid Corrosion of Iron with Triphenyl Tetrazolium Chloride", Corrosion Science, vol. 22, No. 8, pp. 717–721, 1982.

Horner et al., Werkstoffe und Korrosion, 29, 654–664 (1978), which includes an English language abstract.

Horner et al., Werkstoffe und Korrosion, 36, 545–553 (1985), which includes an English language abstract.

* cited by examiner

METHOD AND COMPOSITION FOR INHIBITING CORROSION IN AQUEOUS SYSTEMS

Metals are widely used in the construction of equipment associated with aqueous systems. By "aqueous systems" it is meant any system containing metals which contain or are or contacted with aqueous fluids on a regular basis. Water-based fluids are typically fluids that contain at least about 50 weight percent water, the remainder being solids (suspended and/or dissolved) and/or nonaqueous fluids. The term aqueous fluids is intended to include not only water-based fluids, but also fluids that are predominantly non-aqueous but have sufficient water present, at least about 5 weight percent water, so that water soluble treatment components may be effectively employed to limit corrosion. Such non-aqueous fluids may be miscible or immiscible with water.

Typical aqueous systems include, but are not limited to, open recirculating cooling systems which obtain their source of cooling by evaporation, closed loop cooling systems, boilers and similar steam generating systems, heat exchange equipment, reverse osmosis equipment, oil production systems, flash evaporators, desalinization plants, gas scrubbers, blast furnaces, paper and pulp processing equipment, steam power plants, geothermal systems, food and beverage processing equipment, sugar evaporators, mining circuits, bottle washing equipment, soil irrigation systems, closed circuit heating systems for residential and commercial use, aqueous-based refrigeration systems, down-well systems, aqueous machining fluids (e.g. for use in boring, milling, reaming, broaching, drawing, turning, cutting, sewing, grinding and in thread-cutting operations, or in non-cutting shaping, spinning, drawing, or rolling operations), aqueous scouring systems, aqueous glycol anti-freeze systems, water/glycol hydraulic fluids, ferrous-surface pre-treatment, polymer coating systems, and the like. Various types of water may be utilized in such systems, for example fresh water, brackish water, sea water, brines, sewage effluents, industrial waste waters, and the like.

The aqueous systems that may be treated using the compositions of this invention may contain dissolved oxygen, such as might be obtained from absorbing oxygen from ambient air, or they may be substantially or completely oxygen free. Further, the aqueous system may contain other dissolved gases such as carbon dioxide, hydrogen sulfide, or ammonia, or they may be substantially or completely free of such gases.

There may be several different types of corrosion encountered in aqueous systems. For example, aqeuous systems may have uniform corrosion over the entire metal surface. The aqueous system may also have localized corrosion, such as pitting or crevice corrosion, where the corrosion is found only in certain locations on the metal surface. Often, control of localized corrosion may be the critical factor in prolonging the useful life of the metal equipment in the aqueous system. In particular, aqueous systems which contain high levels of aggressive anions such as chloride and sulfate are particularly prone to both generalized and localized attack. These aggressive anions may be present in the water source used for the aqueous system at levels that cause problems, or they may be concentrated to harmful levels in the aqueous system because they are part of a system that evaporates water such as an evaporative cooling system.

Localized corrosion may pose even a greater threat to the normal operation of the system than general corrosion because such corrosion will occur intensely in one location and may cause perforations in the system structure carrying the fluid stream. Obviously, these perforations may cause leaks which require shutdown of the entire aqueous system so that repair can be made. Indeed, corrosion problems usually result in immense maintenance costs, as well as costs incurred as a result of equipment failure. Therefore, the inhibition of metal corrosion in aqueous systems is critical.

In the descriptions that follow, we utilize the terms oligomer, polymer, co-oligomer, and co-polymer. By oligomer we mean materials produced by the polymerization of a single monomer where the number of monomer units incorporated in the product is between 2 and about 10. By polymer, we mean materials produced by the polymerization of a single monomer without restriction on the number of monomer units incorporated into the product. By co-oligomer, we mean materials produced by the polymerization of more than one type of monomer (including 2, 3, 4, etc. different monomers) where the total number of monomer units incorporated in the product is between 2 and about 10. By co-polymers, we mean materials produced by the polymerization of more than one type of monomer (including 2, 3, 4, etc. different monomers) without restriction on the number of monomer units incorporated into the product.

We have discovered that certain tetrazolium compounds given by the generalized formula:

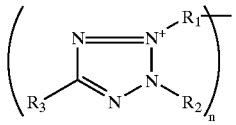

wherein $R_1$, $R_2$ and $R_3$ can be various organic and inorganic substituents, e.g., from the group consisting of lower alkyl, branched lower alkyl, aryl, substituted aryl, alkylaryl, substituted alkylaryl and heterocyclic substituted aryl with the proviso that none of $R_1$, $R_2$ or $R_3$ contain more than 14 carbon atoms, and n may be 1 or 2, synergistically combine with a wide range of compounds to provide effective general and localized corrosion protection for metals in aqueous systems. If the components chosen to be combined with the tetrazolium compounds are also scale and/or deposition inhibitors, the combinations will also provide scale and/or deposition inhibition for these aqueous systems.

Anions and/or cations may be associated with the above structure to balance the charge depending upon the substitutions employed. If $R_1$, $R_2$ and $R_3$ are all neutral, then the structure shown in the above formula will be positively charged and anionic species will be needed.

Examples of such tetrazolium compounds that may be utilized according the this invention include Nitroblue Tetrazolium chloride (3,3'-(3,3'-Dimethoxy-4,4'-biphenylene)-bis-[2-p-nitrophenyl-5-phenyl-2H-tetrazolium chloride]), hereafter referred to as NBT, Distyryl Nitroblue Tetrazolium Chloride (2,2'-Di-p-nitrophenyl-5,5'-distyryl-3,3'-[3,3'-dimethoxy-4,4'-biphenylene]ditetrazolium chloride), hereafter referred to as DNBT, Tetranitroblue Tetrazolium chloride (3,3'-(3,3'-Dimethoxy-4,4'-biphenylene)-bis-[2,5-p-nitrophenyl-2H-tetrazolium chloride]), hereafter referred to as TNBT, and Iodonitro tetrazolium chloride (2-(4-Iodophenyl)3-(4-nitrophenyl)-5-phenyltetrazolium chloride) hereafter referred to as INT.

Examples of compounds that may be combined with the tetrazolium compounds to provide synergistically improved corrosion protection include: inorganic phosphates, such as orthophosphates or polyphosphates, borates, nitrites, and compounds that release a metal anion in water, where the metal anion is selected from the group consisting of molybdates, tungstates, vanadates, metavanadates, chromates or mixtures thereof.

Additional materials that may be combined with the tetrazolium compounds include polycarboxylates. The polycarboxylates may be simple aliphatic compounds containing between 4 and about 20 carbon atoms which are multiply substituted with carboxylate groups (e.g., $C_4$–$C_{15}$α,ω-dicarboxylates or compounds such as 1,2,3,4-butanetetracarboxylic acid) or may be polymeric compounds. The polymeric polycarboxylates may be homopolymers or copolymers (including terpolymers, tetrapolymers, etc.) of ethylenically unsaturated monomers that contain a carboxyl group. Examples of such polymeric polycarboxylates include polyacrylic acid, polymaleic acid, and polymaleic anhydride. Additionally, the polycarboxylates may be hydrocarbyl polycarboxylates as disclosed in U.S. Pat. No. 4,957,704, herein incorporated by reference.

Additional materials which may be combined with the tetrazolium compounds of the present invention include alkyl hydroxycarboxylic acids or a mixture of such alkyl hydroxycarboxylic acids having the formula:

$$HOOC—(R_{B1})_a—(R_{B2})_b—(R_{B3})_c—R_{B4}$$

where a, b, and c are integers from 0 to 6 and (a+b+c)>0 where $R_{B1}$, $R_{B2}$, $R_{B3}$ comprise C═O or CYZ, where Y and Z are separately selected from the group of H, OH, CHO, COOH, $CH_3$, $CH_2(OH)$, $CH(OH)_2$, $CH_2(COOH)$, CH(OH)COOH, $CH_2(CHO)$ and CH(OH)CHO, so selected that the molecule has a minimum of one OH group when written in its fully hydrated form and $R_{B4}$ is either H or COOH, including the various stereoisomers and chemically equivalent cyclic, dehydrated, and hydrated forms of these acids and hydrolyzable esters and acetals that form the above compounds in water or the water soluble salts of such alkyl hydroxycarboxylic acids. Examples of such hydroxycarboxylic acids include tartaric acid, mesotartaric acid, citric acid, gluconic acid, glucoheptonic acid, ketomalonic acid and saccharic acid.

Additional materials which may be combined with tetrazolium compounds include aminohydroxysuccinic acid compounds (or mixtures of such aminohydroxysuccinic acid compounds) such as those disclosed in U.S. Pat. No. 5,183,590, herein incorporated by reference. Suitable aminohydroxysuccinic acids include those selected from the group consisting of compounds of the generalized formulas:

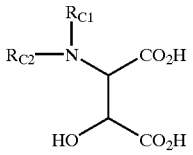

wherein $R_{C1}$ is H or $C_1$ to $C_4$ alkyl, optionally substituted with —OH, $CO_2H$, —$SO_3H$, or phenyl, $C_4$ to $C_7$ cycloalkyl, or phenyl which is optionally substituted with —OH or —$CO_2H$, and $R_{C2}$ is H, $C_1$ to $C_6$ alkyl, optionally substituted with H or —$CO_2H$ (specifically including the moiety —CH($CO_2H$)CH(OH)($CO_2H$)); and

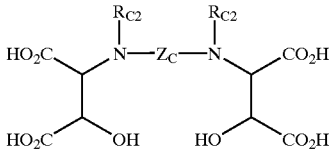

wherein $R_{C2}$ is as above, and $Z_C$ is selected from the group consisting of i) —$(CH_2)$wherein k is an integer from 2 to 10, ii) —$(CH_2)_2$—$X_C$—$(CH_2)_2$— wherein $X_C$ is —O—, —S—, —$NR_{C3}$—, wherein $R_{C3}$ is selected from the group consisting of H, $C_1$ to $C_6$ alkyl, hydroxyalkyl, carboxyalkyl, acyl, —C(O)$OR_{C4}$ wherein $R_{C4}$ is selected from the group consisting of $C_1$ to $C_6$ alkyl or benzyl and a residue having the general formula:

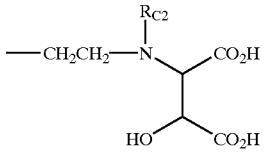

wherein $R_{C2}$ is as above, iii) a residue having the generalized formula:

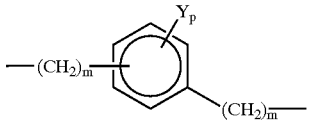

wherein Y is H, $C_1$ to $C_6$ alkyl, alkoxy, halogen, —$CO_2H$, —$SO_3H$, m is independently 0 or 1, and p is 1 or 2, and iv) a residue having the generalized formula:

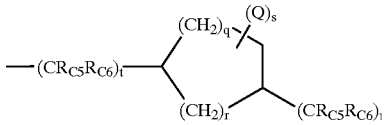

wherein $R_{C5}$ and $R_{C6}$ are independently H or $C_1$ to $C_6$ alkyl, Q is H or $C_1$ to $C_6$ alkyl, s is 0, 1 or 2, t is independently 0, 1, 2, or 3, q is 0, 1, 2, or 3, and r is 1 or 2 or water soluble salts thereof. Preferred examples of such aminohydroxysuccinic acid compounds include iminodi(2-hydroxysuccinic acid), N,N'-Bis(2-hydroxysuccinyl)-1,6-hexanediamine, and N,N'-Bis(2 hydroxysuccinyl)-m-xylylenediamine, or the water soluble salts thereof.

Additional materials which may be combined with the tetrazolium compounds include the carboxyamine compounds which are reaction products of carboxylating agents such as epoxysuccinic acid with amines comprising a plurality of nitrogen atoms such as polyethylene polyamines as disclosed in the International Patent Application WO 96/33953, herein incorporated by reference.

Additional materials which may be combined with the tetrazolium compounds include polyepoxysuccinic acids (referred to as PESAs) of the general formula:

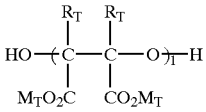

where l ranges from about 2 to about 50, preferably 2 to 25; $M_T$ is hydrogen or a water soluble cation such as $Na^+$, $NH_4^+$, or $K^+$ and $R_T$ is hydrogen, $C_{1-4}$ alkyl or $C_{1-4}$ substituted alkyl (preferably $R_T$ is hydrogen). The use of PESAs in treating aqueous systems has been disclosed in U.S. Pat. Nos. 5,062,962 and 5,344,590. A corrosion inhibition process utilizing a combination of an orthophosphate, a polyepoxysuccinic acid, an acrylic acid/allyl hydroxy propyl sulfonic acid polymer, and an azole has been disclosed in U.S. Pat. No. 5,256,332, herein incorporated by reference.

Modified polyepoxysuccinic acids of the general formula:

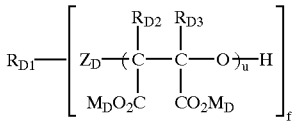

wherein $R_{D1}$, when present, is H, a substituted or non-substituted alkyl or aryl moiety having a carbon chain up to the length where solubility in aqueous solution is lost, or a repeat unit obtained after polymerization of an ethylenically unsaturated compound; $R_{D2}$ and $R_{D3}$ each independently are H, $C_1$ to $C_4$ alkyl or $C_1$ to $C_4$ substituted alkyl; $Z_D$ is O, S, NH, or $NR_{D1}$, where $R_{D1}$ is as described above, u is a positive integer greater than 1; f is a positive integer; and $M_D$ is H, a water soluble cation (e.g., $NH_4^+$, alkali metal), or a non-substituted lower alkyl group having from 1 to 3 carbon atoms (when $R_{D1}$ is not present, $Z_D$ may be $M_DO_3S$, where $M_D$ is as described above) may also be effectively combined with the tetrazolium compounds of the present invention. Use of such compounds have been disclosed in U.S. Pat. Nos. 5,871,691 and 5,489,666, herein incorporated by reference. Examples of such modified polyepoxysuccinic acids include derivatives according to the above formula where $R_{D1}$ is meta-$CH_2$—$C_6H_4$—$CH_2$—(m-Xylylene), $Z_D$ is —NH—, both $R_{D2}$ and $R_{D3}$ are H, f is 2, and $M_D$ is Na. Practical examples are typically mixtures where the individual molecules have a range of u, and are hereafter referred to as m-Xylylenediamine/PESA derivatives.

Additional compounds that may be combined with the tetrazolium compounds include 2,3-dihydroxybenzoic acid and 1,10-phenanthroline.

Additional compounds that may be combined with the tetrazolium compounds include monophosphonic acids having the generalized formula:

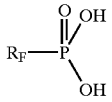

wherein $R_F$ is a $C_1$ to $C_{12}$ straight or branched chain alkyl residue , a $C_2$ to $C_{12}$ straight or branched chain alkenyl residue, a $C_5$ to $C_{12}$ cycloalkyl residue, a $C_6$ to $C_{10}$ aryl residue, or a $C_7$ to $C_{12}$ aralkyl residue, and where $R_F$ may additionally be singly or multiply substituted with groups independently chosen from hydroxyl, amino, or halogen; and diphosphonic acid compounds having the generalized formula:

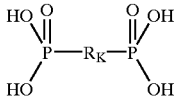

wherein $R_K$ is a $C_1$ to $C_{12}$ straight or branched chain alkylene residue, a $C_2$ to $C_{12}$ straight or branched chain alkenylene residue, a $C_5$ to $C_{12}$ cycloalkylene residue, a $C_6$ to $C_{10}$ arylene residue, or a $C_7$ to $C_{12}$ aralkylene residue where $R_K$ may additionally be singly or multiply substituted with groups independently chosen from hydroxyl, amino, or halogen, or water soluble salts thereof. A preferred example of such a diphosphonic acid is 1-hydroxyethane-1,1-diphosphonic acid (HEDP).

Additional materials which may be combined with the tetrazolium compounds include phosphonocarboxylic acids (or mixtures of such phosphonocarboxylic acids) such as those disclosed in U.S. Pat. Nos. 3,886,204, 3,886,205, 3,923,876, 3,933,427, 4,020,101 and 4,246,103, all herein incorporated by reference. Preferred are those phosphonocarboxylic acids defined by the following generalized formulas:

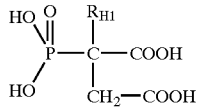

and

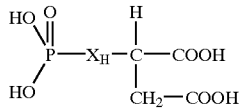

where $R_{H1}$ is H, alkyl, alkenyl, or alkinyl radical having 1 to 4 carbon atoms, an aryl, cycloalkyl, or aralkyl radical, or the radical selected from the following:

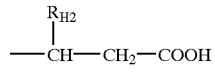

and

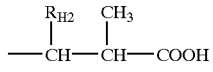

where $R_{H2}$ is H, alkyl radical of 1 to 4 carbon atoms, or a carboxyl radical; and $X_H$ is selected from the following:

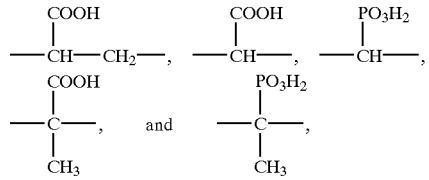

and where the —$PO_3H_2$ group is the phosphono group

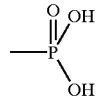

or water-soluble salts thereof. An example of such a preferred phosphonocarboxylic acid is 2-phosphonobutane-1,2,4-tricarboxylic acid.

Additional materials which may be combined with the tetrazolium compounds include hydroxyphosphonocarboxylic acids (or mixtures of such hydroxyphosphonocarboxylic compounds) such as those disclosed in U.S. Pat. Nos. 4,689,200 and 4,847,017, both herein incorporated by reference. Suitable hydroxyphosphonocarboxylic acids includes those having the generalized formula:

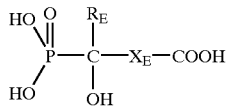

wherein $R_E$ is H, a $C_1$ to $C_{12}$ straight or branched chain alkyl residue, a $C_2$ to $C_{12}$ straight or branched chain alkenyl residue, a $C_5$ to $C_{12}$ cycloalkyl residue, a $C_6$ to $C_{10}$ aryl residue, or a $C_7$ to $C_{12}$ aralkyl residue, $X_E$ is an optional group, which when present is a $C_1$ to $C_{10}$ straight or branched chain alkylene residue, a $C_2$ to $C_{10}$ straight or branched chain alkenylene residue, or a $C_6$ to $C_{10}$ arylene residue or water soluble salts thereof. A preferred example of such a hydroxyphosphonocarboxylic acid is 2-hydroxyphosphonoacetic acid.

Additional materials which may be combined with the tetrazolium compounds include aminophosphonic acids such as those disclosed in U.S. Pat. Nos. 3,619,427, 3,723,347, 3,816,333, 4,029,696, 4,033,896, 4,079,006, 4,163,733, 4,307,038, 4,308,147 and 4,617,129, all herein incorporated by reference. Suitable aminophosphonic acids include those having the generalized formula:

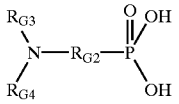

where $R_{G2}$ is a lower alkylene having from about one to about four carbon atoms, or an amine, hydroxy, or halogen substituted lower alkylene; $R_{G3}$ is $R_{G2}$—$PO_3H_2$, H, OH, amino, substituted amino, or $R_F$ as previously defined; $R_{G4}$ is $R_{G3}$ or the group represented by the generalized formula:

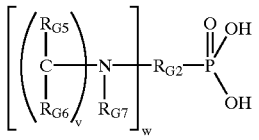

where $R_{G5}$ and $R_{G6}$ are each independently chosen from H, OH, amino, substituted amino, or $R_F$ as previously defined; $R_{G7}$ is $R_{G5}$, $R_{G6}$, or the group $R_{G2}$—$PO_3H_2$ with $R_{G2}$ as previously defined; v is an integer from 1 to about 15; and w is an integer from 1 through about 14 or water soluble salts thereof. An example of such an aminophosphonic acid is diethylenetriamine penta(methylenephosphonic acid).

Additional materials which may be combined with the tetrazolium compounds include water soluble phosphonomethyl amine oxides (or mixtures of such water soluble phosphonomethyl amine oxides) such as those disclosed in U.S. Pat. Nos. 5,051,532, 5,096,595, and 5,167,866, all herein incorporated by reference. Suitable phosphonomethyl amine oxides include those having the generalized formula:

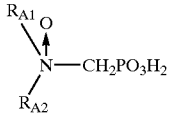

wherein either $R_{A1}$ is selected from the group consisting of hydrocarbyl, and hydroxy-substituted, alkoxy-substituted, carboxyl-substituted and sulfonyl-substituted hydrocarbyl; and $R_{A2}$ is selected from the group consisting of hydrocarbyl, and hydroxy-substituted, alkoxy-substituted, carboxyl-substituted and sulfonyl-substituted hydrocarbyl, —$CH_2PO_3H_2$, and

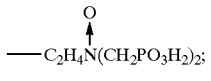

or $R_{A1}$ and $R_{A2}$ together form an alicyclic ring having 3 to 5 carbon atoms in the ring or a water-soluble salt of said phosphonomethyl amine oxide. Hydrocarbyl includes alkyl, aryl, and alkaryl groups which do not render the amine oxide insoluble in water. A preferred example of such a phosphonomethylamine oxide is N,N-bis-phosphonomethylethanolamine N-oxide, hereafter referred to as EBO.

Additional materials which may be combined with the tetrazolium compounds include polymeric amine oxides as described in U.S. Pat, No. 5,629,385, herein incorporated by reference, polyether polyaminomethylene phosphonates and polyether polyamino methylene phosphonate N-oxides, as described in U.S. Pat. Nos. 5,338,477 and 5,322,636, respectively, both herein incorporated by reference, and iminoalkylenephosphonic acids, as described in U.S. Pat. No. 5,788,857, herein incorporated by reference.

Additional materials which may be combined with the tetrazolium compounds include phosphorus-containing carboxylate materials (hereafter, P-carboxylates) which are telomeric, co-telomeric, polymeric or co-polymeric compounds that include at least one organic phosphorus group and multiple carboxylate groups. Optionally, these materials may also include other substituent groups when the P-carboxylates are produced from monomers which contain substituents other than carboxylate. The phosphorus may be present as an end group, in which case it may be a phosphono or end-type phosphino-type moiety, or may be incorporated into the compound as a phosphino moiety in which the phosphorus is directly bonded to two carbon atoms, a configuration sometimes referred to as a "dialkyl" phosphino moiety. These possibilities are shown schematically below.

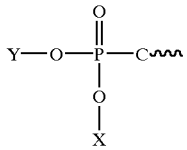

PHOSPHONO

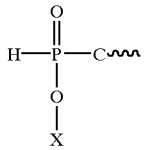

END-TYPE PHOSPHINO

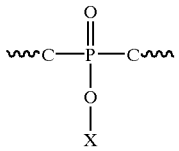

DIALKYL-TYPE PHOSPHINO

X may be hydrogen or a cationic species such as an alkali metal ion, an ammonium ion, or a quaternized amine radical. Y may be the same as X or additionally may be a substituted or non-substituted akyl, aryl, or akylaryl residue, where the substitutions may or may not contain carboxylate. Y must be chosen so as to maintain adequate solubility of the compound in water. The carbon atoms shown are part of the carbon backbone of the telomer, co-telomer, polymer, or co-polymer, this backbone containing at least two carboxyl groups and optionally other phosphorus incorporations and optionally other non-carboxyl substitutions.

Preferred are P-carboxylates having number average molecular weights under 10,000, and particularly preferred are oligomeric or polymeric P-carboxylates of low number average molecular weight, e.g., 2,000 or less, and especially 1,000 or less. It is particularly preferred that 2 or more carboxylates are substituted on a linear alkyl residue, in order of preference, in a 1,2-(adjacent) or a 1,3-substitution arrangement. The P-carboxylates may contain the phosphorus substitution or substitutions predominantly or exclusively as phosphono species, predominantly or exclusively as end-type phosphino species, predominantly or exclusively as dialkylphosphino species, or contain a mixture of these substitution types on an individual molecule and/or in the mixture of molecules generated by a particular preparative process. The various preparative processes used for P-carboxylates may also generate various inorganic phosphorus species as part of the synthetic process. Such mixtures of P-carboxylates and the associated inorganic phosphorus species when combined with tetrazolium compounds are considered to be within the scope of this invention.

Non-limiting examples of the preparation of P-carboxylates suitable for use in this invention and their use as corrosion and/or scale control agents alone and in combination with other water treatment agents in aqeuous systems are disclosed in U.S. Pat. Nos. 2,957,931, 4,046,707, 4,088,678, 4,105,551, 4,127,483, 4,159,946, 4,207,405, 4,239,648, 4,563,284, 4,621,127, 4,681,686, 5,023,000, 5,073,299, 5,077,361, 5,085,794, 5,160,630, 5,216,099, 5,229,030, 5,256,302, 5,256,746, 5,294,687, 5,360,550, 5,376,731, 5,386,038, 5,409,571, 5,606,105, 5,647,995, 5,681,479, and 5,783,728 and European Patents 283191A2, 360746B1, 569731A2, 681995A3, 786018A1, 792890A1, 807635A1, 807654A2, and 861846A2, all herein incorporated by reference. As may be appreciated by examination of these patents, a variety of preparative processes are suitable for producing P-carboxylates useful for this invention. It is not the object of this invention to specify any particular process or method for making the P-carboxylates suitable for use in this invention. In general, they may be produced by reacting a phosphorus containing material with one or more polymerizable monomers, at least one of which contains carboxyl groups or groups which can be made to generate a carboxyl in the final compound (after the polymerization process) by further reactions such as hydrolysis, oxidation, and the like, such monomers being hereafter referred to as carboxyl monomers. The processes disclosed in the art typically involve reaction of a phosphorus-containing material with one or more unsaturated monomers, at least one of which is a carboxyl monomer, to generate P-carboxylate oligomers or polymers. Examples of suitable carboxyl monomers include acrylic acid, maleic acid, maleic anhydride, methacrylic acid, itaconic acid, crotonic acid, vinyl acetic acid, fumaric acid, citraconic acid, mesaconic acid, acrylonitrile, methacrylonitrile, alpha-methylene glutaric acid, cyclohexenedicarboxylic acid, cis-1,2,3,6-tetrahydrophthalic anhydride, 3,6-epoxy-1,2,3,6-tetrahydrophthalic anhydride, 5-norbornene-2,3-dicarboxylic anhydride, bicyclo[2.2.2]-5-octene-2,3-dicarboxylic anhydride, 3-methyl-1,2,6-tetrahydrophthalic anhydride, and 2-methyl-1,3,6-tetrahydrophthalic anhydride. Preferred carboxyl monomers are acrylic acid, maleic acid, itaconic acid, and maleic anhydride.

Although it is preferred that P-carboxylate materials contain a major proportion of residues that bear carboxyl groups, it may be advantageous to utilize co-oligomeric or co-polymeric P-carboxylates that contain residues that are derived from at least one carboxyl monomer and a minor proportion (under 50 percent by weight of the total product) of residues obtained from at least one other monomer that is not a carboxyl monomer. A wide variety of suitable non-carboxyl monomers exist, including, for example, 2-acrylamido-2-methylpropanesulfonic acid (commercially available as AMPS™ from the Lubrizol Corporation), 2-hydroxy-3-(2-propenyloxy)propanesulfonic acid, 2-methyl-2-propene-1-sulfonic acid, allylsulfonic acid, allyloxybenzenesulfonic acid, styrenesulfonic acid, vinylsulfonic acid, allylphosphonic acid, vinylphosphonic acid, isopropenylphosphonic acid, phosphoethyl methacrylate, hydroxyalkyl and $C_1$–$C_4$ alkyl esters of acrylic or methacrylic acid, acrylamides, alkyl substituted acrylamides, allyl alcohol, 2-vinyl pyridine, 4-vinyl pyridine, N-vinylpyrrolidone, N-vinylformamide, N-vinylimidazole, vinyl acetate, hydrolyzed vinyl acetate, and styrene.

Specifically included within the category of P-carboxylates are phosphonic polymers having the generalized formula:

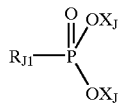

wherein $X_J$ is H, an alkali metal atom, an alkaline earth metal atom, or an ammonium or amine residue; and $R_{J1}$ is a copolymer residue comprising two different residues

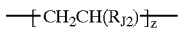

wherein z is an integer ranging from 2 to 100, and wherein, in the first residue, $R_{J2}$ is —COOH, and in the second residue, $R_{J2}$ is $—CONHC(CH_3)_2CH_2SO_3X_J$, wherein $X_J$ is as hereinbefore defined.

Non-limiting examples of P-carboxylate materials suitable for use in this invention include Belsperse 161, Belciene 400, Belclene 494. Belclene 500 (all commercially available products of FMC corporation), phosphonosuccinic acid, and Bricorr 288 (a product of Albright and Wilson). Bricorr 288 is described as a composition which consists essentially of up to 50% by weight of a phosphonosuccinic acid, based on the weight of the composition, a phosphonated dimer of alkali metal maleate, not more than a minor proportion by weight, based on the weight of the dimer, of higher phosphonated oligomers of maleate; and from about 0.5 to about 5% by weight of the composition of an alkali metal phosphate.

Additional materials which may be combined with the tetrazolium compounds include long chain fatty acid derivatives of sarcosine (or mixture of such fatty acid sarcosine derivatives) or their water soluble salts. An example of such a derivative is N-Lauroylsarcosine.

The tetrazolium compounds of this inventions may also be combined with water soluble alkali metal silicates. Such silicates are well known in the art as corrosion inhibitors for both ferrous metals and aluminum, both in systems where the fluid is predominantly water as well as in glycol-based aqeuous systems typically used as antifreeze coolants for internal combustion engines. The sodium silicates may be represented generically by the formula $Na_2O.xSiO_2.yH_2O$ where x is in the range of about 1 to about 3.5. Commerical sodium silicate solutions in which the mole ratio of silica to soda is about 3.3 may be used. More alkaline solutions having an $SiO_2$:$Na_2O$ mole ratio as low as about 1:1 or less alkaline solutions having a an $SiO_2$:$Na_2O$ mole ratio up to about 3.5:1 can also be used. Other alkali metal silicate salts, especially potassium silicate may also be employed. When using water soluble alkali metal silicates in the practice of the current invention, it may be advantageous to combine the silicates with other inhibitors and/or silica stabilizers. Examples of such suitable combinations are disclosed in U.S. Pat. Nos. 3,711,246, 4,085,063, 4,404,114, 5,137,657, 5,262,078, 5,578,246, and 5,589,106, all herein incorporated by reference.

The tetrazolium compounds of this inventions may also be combined with water soluble monofluorophosphate salts. The use of such salts as corrosion inhibitors for metallic sufaces has been disclosed in U.S. Pat. Nos. 4,132,572 and 4,613,450, both herein incorporated by reference. As disclosed in U.S. Pat. No. 5,182,028, herein incorporated by reference, such salts also have utility for calcium carbonate scale control and in iron and manganese stabilization.

A wide variety of additional aqueous system corrosion inhibitors suitable for combination with the tetrazolium materials in this invention are known in the art. Non-limiting examples of such inhibitors may be found in Corrosion Inhibitors, C. C. Nathan, ed., NACE, 1973; I. L. Rozenfeld, Corrosion Inhibitors, McGraw-Hill, 1981; Metals Handbook, $9^{th}$ Ed., Vol. 13—Corrosion, pp. 478497; Corrosion Inhibitors for Corrosion Control, B. G. Clubley, ed., The Royal Society of Chemistry, 1990; Corrosion Inhibitors, European Federation of Corrosion Publications Number 11, The Institute of Materials, 1994; Corrosion, Vol. 2—Corrosion Control, L. L. Sheir, R. A. Jarman, and G. T. Burstein, eds., Butterworth-Heinemann, 1994, pp. 17:10–17:39; Y. I. Kuznetsov, Organic Inhibitors of Corrosion of Metals, Plenum, 1996; and in V. S. Sastri, Corrosion Inhibitors: Principles and Applications, Wiley, 1998. Such inhibitors include amines (e.g., morpholine, cyclohexylamine, benzylamine), alkanolamines, ether amines, diamines, fatty amines and diamines, quaternized amines, oxyalkylated amines, akyl pyridines; tetrazoles such as those disclosed in U.S. Pat. No. 5,744,069, herein incorporated by reference; imidazoline and substituted imidazolines, amidoamines, polyamines, including polyakylenepolyamines such as those disclosed in U.S. Pat. No. 5,275,744, herein incorporated by reference, alkyl derivatives of benzene sulfonic acid, benzoates and substituted benzoates (e.g., p-tert-butylbenzoic acid as disclosed in U.S. Pat. No. 5,275,744, herein incorporated by reference), aminobenzoates, salicylates, dimer-trimer acids, petroleum oxidates, borogluconates; lignins, tannins, and the sulfonated and/or carboxylated derivatives thereof (e.g., lignosulfonates); straight chain $C_5$–$C_{11}$ monocarboxylates, amine salts of carboxylic acids and mercaptocarboxylic acids such as those disclosed in U.S. Pat. No. 5,779,938, herein incorporated by reference; amino acids, polyamino acids, and derivatives thereof such as those disclosed in U.S. Pat. Nos. 4,971,724, 5,531,934, 5,616,544, 5,750,070, and 5,785,896 herein incorporated by reference; hydroxyether acids and related lactone compounds such as those disclosed in U.S. Pat. No. 5,055,230 herein incorporated by reference, N-acyl sarcosines, N-acyliminodiacetic acids; triazine di- and tri-carboxylic acids such as those disclosed in U.S. 4,402,907, herein incorporated by reference, and phospho- and phosphate esters (e.g., of ethoxylated alcohols) such as those disclosed in U.S. Pat. Nos. 3,873,465, 3,932,303, 4,066,398, and 5,611,991, herein incorporated by reference.

In the practice of this invention is may be advantageous to employ additional agents to enhance or add additional functionality to the combinations of this invention. Suitable additional agents include dispersants, copper corrosion inhibitors, aluminum corrosion inhibitors, water soluble metal salts and their chelates, scale and deposit control agents, sequestering agents, anti-foams, oxidizing and non-oxidizing biocides, non-ionic and ionic freezing point depressants, pH adjusting agents, inert and active tracers, water insoluble and soluble lubricants, surfactants, calcium hardness adjusting agents, and coloring agents.

Dispersants are often needed to maintain system cleanliness when the aqueous system contain suspended particulate matter. A wide variety of polymeric and non-polymeric dispersants are known in the art which may be used in the practice of this invention. Preferred are a) water-soluble sulfonated polymers or copolymers obtained from the polymerization of one or more ethylenically unsaturated monomers, at least one of which contains sulfonate functionality, or the water soluble salts thereof or b) copolymers of diiosbutylene and maleic anhydride with molecular weights <10,000 or the water soluble salts thereof. Particularly preferred is about a 3:1 weight ratio copolymer of acrylic acid and allyl hydroxy propyl sulfonate ether or the water soluble salts thereof.

Additional agents that may be combined with the tetrazolium compounds of this invention include copper corrosion inhibitors, including heterocyclic ring type copper inhibitors such as azole compounds. As is well known in the art, azoles are typically used to provide corrosion protection for copper-based alloys. However, as is also known in the art, in certain systems azoles and similar heterocyclic ring type copper inhibitors additionally provide corrosion protection for ferrous-based metals and/or aluminum, and the use of such materials for these purposes is considered to be within the scope of this invention. As one skilled in the art may readily appreciate, the use of copper inhibitors in the practice of this invention may enhance the performance of the compositions of this invention in protecting a particular metal system and/or may extend the applicability to multi-metal systems.

Suitable azole compounds include triazoles, tetrazoles, pyrazoles, imidazoles, isoxazoles, oxazoles, isothiazoles, and thiazoles, all optonally substituted with alkyl, aryl, aralkyl, alkylol, and alkenyl radicals, including those disclosed in U.S. Pat. Nos. 2,618,608, 2,742,369, and 2,941,953 and summarized in U.S. Pat. No. 4,101,441, all herein incorporated by reference. Examples of suitable azoles and related heterocylic ring compounds include benzotriazole, tolyltriazole, alkyl or alkoxy substituted benzotriazoles, including n-butyl and hexyloxy substituted benzotriazoles, wherein the substitution occurs on the 4 or 5 position of the benzene ring, 2-mercaptobenzothiazole, 2-mercaptobenzotriazole,1,2,3-triazole, 4-phenyl-1,2,3-triazole, 1,2-napthotriazole, 4-nitrobenzotriazole, pyrazole, 6-nitroindazole, 4-benzylpyrazole, 4,5-dimethylpyrazole, 3-allylpyrazole, imidazole, adenine, guanine, benzimidazole, 5-methyl benzimidazole, 2-phenyl imidazole, 2-benzyl imidazole, 4-allylimidazole, 4-(betahydroxy ethyl)-imidazole, purine, 4-methylimidazole, xanthine, hypoxanthine, 2-methyl imidazole, isoxazole, benzisoxazole, 3-mercaptobenzisoxazole, oxazole, 2-mercapto oxazole, 2-mercaptobenzoxazole, isothiazole, 3-mercaptoisothiazole, 2-mercaptobenzisothiazole, benzisothiazole, thiazole, 2,5-dimercaptothiadiazole, 2,5-dimercaptobenzotriazole, 5,5'-methylene-bis-benzotriazole, and 4,5,6,7-tetrahydrobenzotriazole. Additional suitable azoles include those disclosed in U.S. Pat. Nos. 3,985,503, 4,298,568, 4,734,257, 4,744,950, 4,874,579, 5,217,686, and 5,236,626, all incorporated herein by reference, and 1-phenyl-5-mercaptotetrazole as disclosed in U.S. Pat. No. 5,156,769, herein incorporated by reference. Suitable azoles include mixed compositions such as a tolyltriazole composition which includes at least 65% of the 5-methylbenzotriazole isomer by weight as disclosed in U.S. Pat. No. 5,503,775, herein incorporated by reference. Particularly suitable are halogen-tolerant azoles which give improved corrosion performance, no objectionable odor, and reduced biocide comsumption when halogen-based oxidizing biocides (e.g., chlorine) are used in the aqueous system. Non-limiting examples of such halogen-tolerant azoles are disclosed in U.S. Pat. Nos. 5,772,919, 5,863,463 and 5,863,464, herein incorporated by reference, and include chloro-tolyltriazole, bromotolyltriazole, mono-halobenzotriazole, di-halobenzotriazole, and mixtures of mono-halo and di-halobenzotriazoles.

Preferred azoles are tolyltriazole, benzotriazole and halogen-tolerant azoles, especially chloro-tolyltriazole.

Additional agents that may be combined with the tetrazolium compounds of this invention include aluminum corrosion inhibitors. Preferred are water soluble nitrate salts, particularly sodium nitrate, and the combination of nitrate salts with alkali metal silicates.

Additional agents that may be combined with the tetrazolium compounds of this invention include water-soluble metal salts of metals chosen from the group zinc, manganese, aluminum, tin, nickel, yttrium, and the rare earth metals (atomic numbers 57 to 71) and/or organic metal chelates of such metals, where the organic chelant is chosen to impart a desired level of water solubility of the metal ion. As is known in the art, such metal salts and chelates may be utilized to provide additional corrosion protection. The metal salt can be obtained from manganese in the +2 oxidation state, such as wherein the manganese salt state is the sulfate, chloride, acetate, or nitrate salt.

The use of zinc ions as a corrosion inhibitor is well known in the art, especially in combination with other water treatment agents such as phosphates, phosphonates, P-carboxylates, carboxylates and hydroxycarboxylates. Preferred sources of zinc ions are the sulfate, chloride, acetate, or nitrate zinc salts and the zincate ion obtained by dissolving zinc oxide in base. Particularly preferred are the sulfate and chloride salts and the zincate ion.

The use of manganese ion in water treatment in combination with aminophosphonates and with P-carboxylates has been disclosed in U.S. Pat. No. 4,640,818 and in European Patent 283191A2, respectively, both herein incorporated by reference. The use of yttrium and cations of the metals of the lanthanum series having atomic numbers from 57 to 71 and/or organics chelates thereof for corrosion inhibition in aqeuous systems has been disclosed in U.S. Pat. Nos. 4,749,550 and 5,130,052, both herein incorporated by reference. The preferred lanthanum salts are those of lanthanum, praseodymium, and neodymium, and commercially available materials which contain mixtures thereof. The metal salt can be obtained from lanthanum or a mixture of rare earth metals containing lanthanum, with the lanthanum salt or mixture of rare earth metal salts containing lanthanum being independently chosen from the sulfate, chloride, acetate or nitrate salts.

Additional agents that may be combined with the tetrazolium compounds of this invention include scale and deposit control agents. Although many of the previously described combinations of this invention provide both corrosion and scale and/or deposit control (particularly for calcium carbonate scales), there may instances where additional agents must be utilized to control scaling and/or deposition for particular species (e.g., barium sulfate or calcium oxalate). Agents appropriate for control of a variety of such species are known in the art.

Additional agents that may be combined with the tetrazolium compounds of this invention include sequestering agents. Such agents are needed to prevent metallic (e.g., iron, copper) or alkaline earth ions from fouling the aqueous system or from interfering with the proper functioning of corrosion inhibitors or other agents in the system. Such sequestering agents are known in the art and in some cases may be selected to be effective on a specific ion. Non-limiting examples of suitable sequestering agents include ethylenediaminetetra(acetic acid) nitrolotriacetic acid, and N,N-di(2-hydroxyethyl)glycine or water soluble salts thereof.

Additional agents that may be combined with the tetrazolium compounds of this invention include anti-foams. Examples of suitable antifoaming agents include silicones (e.g., polydimethylsiloxanes), distearylsebacamides, distearyladipamide and related products derived from ethylene oxide or propylene oxide condensations, and fatty alcohols, such as capryl alcohols and their ethylene oxide condensates.

Additional agents that may be combined with the tetrazolium compounds of this invention include biocides. The use of biocides may be necessary to control microbiological growth in both the aqueous system and in the feed sources for the compositions of this invention. Both oxidizing and non-oxidizing biocidal agents may be utilized for these purposes. Suitable oxidizing biocides include chorine, hypochlorite, bromine, hypobromite, chlorine and/or bromine donor compounds (e.g., bromochlorohydantoin), peracetic acid, inorganic peroxides and peroxide generators, chlorine dioxide, and ozone. Suitable non-oxidizing biocides include amines, quaternary ammonium compounds (e.g., N-alkyl dimethylbenzylammonium chloride), 2-bromo-2-nitropropane-1,3-diol, β-bromonitrostyrene, dodecylguanidine hydrochloride, 2,2-dibromo-3-nitrilopropionamide, gluteraldhyde, chlorophenols, sulphur-containing compounds such as sulphones, methylene bis thiocyanates and carbamates, isothiazolones, brominated propionamides, triazines (e.g. terbuthylazine, and triazine derivatives such as those disclosed in U.S. Pat. No. 5,534,624 herein incorporated by reference), phosphonium compounds, organometallic compounds such as tributyl tin oxide, and mixtures of such biocides. A preferred non-oxidizing biocide is a mixture of (a) 2-bromo-2-nitropropane-1,3-diol (BNPD) and (b) a mixture of about 75% 5-chloro-2-methyl-4-isothiazolin-3-one and about 25% 2-methyl-4-isothiazolin-3-one, the weight ratio said BNPD (a) to said mixture (b) being about 16:1 to about 1:1 as disclosed in U.S. Pat. No. 4,732,905, herein incorporated by reference.

Additional agents that may be combined with the tetrazolium compounds of this invention include freezing point depressants. Such agents are needed for aqueous systems such as refrigeration, dehumidification, and internal combustion engine coolant systems. The depressants may be ionic or non-ionic in nature. Non-limiting examples of suitable ionic agents include calcium chloride, sodium chloride, lithium bromide, and lithium chloride. Examples of suitable non-ionic agents are water-soluble alcohols such as ethylene glycol, propylene glycol, ethanol, glycerol, isopropanol, methanol, and mixtures thereof.

Additional agents that may be combined with the tetrazolium compounds of this invention include pH adjusting agents. Non-limiting examples of suitable agents include sodium hydroxide, potassium hydroxide, lithium hydroxide, hydrochloric acid, sulfuric acid, nitric acid, carbon dioxide, ammonia, organic acids such as oxalic acid, alkali metal carbonates, and alkali metal bicarbonates.

When the compositions of this invention are used in aqueous systems that involve moving contact between a surface and a metal (e.g., such as encountered in systems containing pumping equipment or in applications involving metal machining or forming), it may be desirable to employ a lubricant to improve the performance of the machining operation or to decrease wear of the contacting and/or metal surface. Such lubricants may be water soluble or water insoluble. Suitable water insoluble organic lubricants such as naturally occurring or synthetic oils include those disclosed in U.S. Pat. No. 5,716,917, herein incorporated by reference. Suitable water soluble lubricants include those disclosed in U.S. Pat. Nos. 3,720,695, 4,053,426, 4,289,636, 4,402,839, 4,425,248, 4,636,321, 4,758,359, 4,895,668, 5,401,428, 5,547,595, 5,616,544, and 5,653,695, herein incorporated by reference. Some lubricants (e.g., those disclosed in U.S. Pat. Nos. 4,405,426 and 5,401,428, all herein incorporated by reference) may additionally impart improved corrosion inhibition performance to the compositions of this invention.

It may be advantageous either in the formulation of stable product containing a mixture of the components of this invention or in the application of the compositions of this invention to a particular aqueous system (particularly those systems in which significant proportions of nonaqueous fluids are present) to additionally employ surfactants. Such surfactants may be anionic, cationic, amphoteric or nonionic in nature and are well known in the art. Such agents may be added to the compositions of this invention for a variety of functions (e.g., as emulsifiers, dispersants, hydrotroping agents, anti-foaming agents, lubricants, corrosion inhibitors). The process of selecting appropriate surfactants for accomplishing a given purpose is well known to those skilled in the art. It is particularly desirable to utilize surface active agents when utilizing additives to the compositions of this invention which have limited solubility in water (e.g., when employing water insoluble organic lubricants or supplementary corrosion inhibitors based on marginally soluble materials such as fatty acid derivatives).

Additional agents that may be combined with the tetrazolium compounds of this invention include calcium hardness adjusting agents. It is well known in the art that the efficacy of many aqueous system corrosion inhibitors, particularly those commonly used to treat open recirculating cooling system, is dependent upon the presence of a certain minimum level of dissolved calcium in the water. Although the efficacy of the compositions of this invention is somewhat independent of dissolved calcium, it may be advantageous in the practice of this invention to increase the dissolved calcium concentration in the system. Non-limiting examples of suitable calcium hardness adjusting agents include the bicarbonate, carbonate, chloride, sulfate, and acetate salts of calcium as well as calcium hydroxide and calcium oxide.

Additional agents that may be combined with the tetrazolium compounds of this invention include coloring agents. Non-limiting examples of the use of such agents include improving product appearance, aiding in product identification, and serving as additives on which automatic feed control systems which utilize calorimetric methods can be controlled. Non-limiting examples of such agents include water soluble dyes.

Suprisingly, it has been found that the tetrazolium compounds combine synergistically with a wide range of known scale and/or corrosion inhibitors to provide greatly increased performance for both generalized corrosion and pitting. The combinations are effective over a range of calcium hardness and pH, including low hardness waters. In some cases, a reduction of one order of magnitude or more in the corrosion rate occurs when employing the combination compared to the treatment without using a tetrazolium compound, even when keeping total active treatment levels constant.

The tetrazolium compounds of this invention are known to be reducible species. While the mechanistic details have not been studied in depth and are not fully understood, it is believed that one important element of the corrosion inhibiting effect of the novel compositions of this invention is the reduction of the soluble tetrazolium compound to a relatively insoluble and protective film at the surface of the corroding metal. The reduction may be a multi-step process, and the protective film may contain several of the intermediate reduction products. Potentially, some of these intermediate reduction products may not be part of the protective film, but may be still capable of further reduction to form a corrosion-inhibiting film. Such corrosion-inhibiting intermediate reduction products of the tetrazolium compounds are also considered to be within the scope of this invention.

The protective action of the tetrazolium compound works in concert with the protective action of the additional water treatment agent to provide effective aqueous system corrosion control. In many cases the additional water treatment agent also provides protection against water formed scales and deposits, and for these cases, the combinations of this invention are effective for the control of both corrosion and scaling/deposition. The additional water treatment agent may impart other desirable properties to the composition (e.g., the ability to disperse particulate matter). However, it is possible for certain water treatment agents (e.g., oxygen scavengers) to cause the reduction of the tetrazolium compound directly in solution, making the tetrazolium compound itself or potential corrosion-inhibiting intermediate reduction products unavailable to form a protective film at the metal surface. Consequently, water treatment agents that substantially reduce tetrazolium compounds in aqueous solution under the particular conditions of use are not suitable for use with this invention. The conditions of use include such considerations as the relative proportions of tetrazolium compound and the tetrazolium-reducing water treatment agent (e.g., the use of an amount of a reducing water treatment agent that did not substantially reduce the amount of tetrazolium compound present would still fall within the scope of this invention). The conditions of use also would include the absolute concentrations of both tetrazolium compounds and other species, temperature, time, the presence or absence of additional oxidizing and/or reducing agents or other compounds that might alter the interaction between the tetrazolium compound and the tetrazolium-reducing water treatment agent, the presence or absence of catalytic surfaces (e.g., metal surfaces), and the like. One skilled in the art may readily determine if a particular agent substantially reduces the tetrazolium compound under the conditions of use. Because the reduction products of the tetrazolium compounds are generally highly colored while the parent materials are not, simple methods of making this determination include visual inspection and colorimetry.

In a preferred embodiment of the present invention, from about 0.5 to 10,000 parts per million of a combination of a tetrazolium compound and an aqueous system treatment material is added to the aqueous system in need of treatment, with from about 10 to 1000 parts per million of said combination being particularly preferred. The weight ratio of the other aqueous system treatment material to tetrazolium compound is preferably from about 100:1 to 1:20, with a weight ratio of from about 20:1 to 1:1 particularly preferred.

The pH of the aqeuous system in which the compositions of this invention may be applied ranges from about 5 to about 12. The pH is preferably in the range from about 6 to about 10.

The components of this invention may be dosed into the aqeuous system at an effective concentration by a slug feed or by blending with the aqueous fluid as the system is being filled. When used to treat aqueous systems in which one or more of the treatment components are discharged from the system or are consumed by chemical or physical processes within the system and thus require replenishment to maintain treatment effectiveness (e.g., open cooling systems), the compositions of this invention may be fed to the system on a continuous basis, on an intermittent basis, or using a combination of the two (e.g., utilizing a continuous low level feed supplemented by slug feeds as needed). Depending upon the application, it may be advantageous to combine the compositions of this invention together into a single treatment fed from one feed supply source, or, alternatively, to separate the components into two or more treatment sources, each source independently being fed continuously or intermittently into the system at a rate needed to maintain adequate concentrations in the system. Single or multiple feed points to the aqueous system for each treatment source may be utilized.

The timing and rate of treatment feed may be controlled by a variety of methods known in the art. One suitable method is to utilize metering pumps or other feed system devices which may be variously configured to feed continuosly at a fixed rate, on a time schedule, on signals generated by other system components such as makeup or blowdown pumps, or on signals generated by an analog or computer-based feed control system. Non-limiting examples of suitable feed systems have been disclosed in U.S. Pat. Nos. 4,648,043, 4,659,459, 4,897,797, 5,056,036, 5,092,739 and 5,695,092. The feed control systems may utilize signals corresponding to the concentration of one or more of the treatment components, to the concentration of one or more inert or active tracer materials added to the treatment, to the value of one or more measures of system performance (e.g., values obtained from corrosion rate meters, scaling monitors, heat transfer monitoring devices, analytical devices that detect the amount corrosion product in the water such as total or dissolved iron or other metal constituent, and the like), to the value of one or more of the physical characteristics of the system (e.g., temperature, flow rate, conductivity), to the value of one or more chemical characteristics of the system (e.g., pH, calcium hardness, redox potential, alkalinity) or to combinations of these signals to feed and maintain levels of treatment adequate for effective performance in a particular aqueous system. Alternatively, it may be advantageous in some systems to employ a controlled release (also referred to as gradual release or time release) delivery system for some or all the compounds of this invention. In such controlled release systems the material or materials to be fed are impregnated or are otherwise incorporated into a controlled release system matrix. Suitable controlled release delivery systems include those in which the matrix is exposed to the fluid in the aqeuous system or to a fluid stream being fed to the aqeuous system and the treatment components are gradually released into the system by the action of various processes (e.g., diffusion, dissolution, osmotic pressure differences) and which may further be designed to vary the release rate in response to aqeuous fluid characteristics such as temperature, flow rate, pH, water hardness, conductivity, and the like. Non-limiting examples of such controlled release delivery systems have been disclosed in U.S. Pat. Nos. 3,985,298, 4,220,153, 5,316,774, 5,364,627, and 5,391,369.

When feed systems are employed that utilize measured concentrations of treatment or tracer components, such concentrations may be determined by continous, semi-continuous, or batch type analytical techniques including spectroscopic methods (UV, visible emission, visible absorption, IR, Raman, fluorescence, phosphorescence, etc.), electrochemical methods (including pH, ORP, and ion selective electrode measurements), chromatographic methods (GC, LC), methods that rely on antibody binding or release, chemical based analytical/colorimetric methods such as those commercially avaiable from the Hach Company, and the like. A suitable spectrophotometric method is described in U.S. Pat. No. 5,242,602, herein incorporated by reference. A suitable method for regulating the in-system concentration of a water treatment agent is disclosed in U.S. Pat. No. 5,411,889. U.S. Pat. No. 5,855,791, herein incorporated by reference, discloses suitable methods for determining the feed rates of corrosion and fouling inhibitors based on certain performance monitors and system characteristics.

The tracer compounds that may optionally be employed may be compounds that serve no particular treatment function, referred to as inert tracers, or may be water treatment compounds that are also readily monitored, such treatment compounds being referred to as active tracers. Suitable tracers include soluble lithium salts such as lithium chloride, transition metals such as described in U.S. Pat. No. 4,966,711, herein incorporated by reference, and fluorescent inert tracers such as described in U.S. Pat. No. 4,783,314, herein incorporated by reference. Suitable fluorescent inert tracers include the mono-, di-, and trisulfonated naphthalenes (e.g., water soluble salts of naphthalene sulfonic acid or of naphthalene disulfonic acid). Suitable active tracers include fluorescently tagged polymers such as described in U.S. Pat. No. 5,171,450, herein incorporated by reference, and polymers containing a photo-inert, latently detectable moiety which will absorb light when contacted with a photoactivator, as described in U.S. Pat. No. 5,654,198, herein incorporated by reference, azole-based copper corrosion inhibitors such as tolyltriazole, and water soluble molybdate and tungstate salts.

Although many of the compounds combined with the tetrazolium compounds are known corrosion inhibitors, they are generally known to be effective only under particular conditions of calcium hardness and pH. For example, certain phosphonocarboxylates such as 2-phosphono-butane-1,2,4-tricarboxylic acid (PBTC) are generally effective as corrosion inhibitors only at pHs exceeding 8 and in waters containing significant calcium hardness (i.e., >200 mg/l as $CaCO_3$). As will be demonstrated, combinations of PBTC with the tetrazolium compounds are very effective at pH 7.6 in a water containing only 100 mg/l calcium as $CaCO_3$. Similar results are seen with other combinations. It is particularly advantageous in many aqueous systems to have treatments that are "robust" with respect to the pH and hardness of the water, i.e., that perform well over a wide range to these conditions.

Use of the tetrazolium compound can significantly reduce the total treatment dosage needed to effectively limit corrosion in the aqueous system. Many of the combinations of the tetrazolium compounds are with materials that are primarily or exclusively utilized as scale and/or deposition inhibitors. However, the combinations are effective for both scaling/deposition and corrosion control.

Test Methods and Conditions

The corrosion inhibition activity of the treatments in the present invention were evaluated using the Beaker Corrosion Test Apparatus (BCTA). The BCTA consists of a 2 liter beaker equipped with an air/CO2 sparge, 1010 low carbon steel (LCS) coupon(s), a 1010 LCS electrochemical probe, and a magnetic stir bar. The test solution volume was 1.9 liters. Air/$CO_2$ sparging is continuous during the test. The reference electrode and counter electrode used in making the electrochemical corrosion measurements are constructed of Hastelloy C22. The beaker is immersed in a water bath for temperature control. Electrochemical corrosion data were obtained periodically on the probe during the test using a polarization resistance technique. All tests were conducted at 120° F., using a 400 RPM stir rate. Unless otherwise noted, the test duration was 18 hours. Two values are reported for each test; EC(avg), the average value of the electrochemically measured corrosion rate during the test, and EC(18 hour), the value of the corrosion rate at the end of the test. The latter value is thought to be more indicative of the longer term corrosion rate expected.

In all tests the coupon(s) immersed in the beaker during the test is photographed. For some tests, the pit depths on the coupons are measured using a microscopic technique (see ASTM G 46-94, section 5.2.4). For these pit measurement tests, two coupons are used and up to 20 pits per coupon are measured (up to 10 per side).

Unless specifically noted otherwise, the test water contains 100 mg/l Ca (as $CaCO_3$), 50 mg/l Mg (as $CaCO_3$), 100 mg/l chloride, and 100 mg/l sulfate. Using this water, tests were conducted at pHs of 8.6, 7.6, and 6.8. The corresponding "M" alkalinities at these pHs were 110, 32, and 4 mg/l (all as $CaCO_3$).

It is relatively difficult to control ferrous metal corrosion in this test water. The relatively low calcium hardness makes it difficult for inhibitors which depend on calcium to function effectively. The relatively high sulfate and chloride levels (for the given calcium level) makes the water aggressive to ferrous metals, particularly with respect to pitting corrosion.

To prevent calcium carbonate and/or calcium phosphate deposition from occurring during the test, many of the tests were conducted using 5 mg/l of a Polyepoxysuccinic Acid (PESA) with a degree of polymerization of about 5 and 5 mg/l active of a copolymer of acrylic acid and allylhydroxypropylsulfonate ether sodium salt (AA/AHPSE) added to the test water. For some tests, only 5 mg/l of AA/AHPSE copolymer was used.

Both addition and substitution (constant inhibitor level) tests were conducted. In former type of test, a low level of a tetrazolium compound (2 to 5 mg/l) was added to a second composition. In the latter test, the second composition was reduced by a given amount (3 to 5 mg/l) and replaced by the same amount of tetrazolium compound.

PERFORMANCE EXAMPLES

Example #1

BCTA results for tests conducted at pH 8.6 are shown in Table 1. The tetrazolium compound utilized for these tests was NBT. Belcor 575 is hydroxyphosphonoacetic sold by FMC. Bricorr 288 is a mixture of phosphonosuccinic acid, the phosphonated dimer of maleic acid, phosphoric acid, and a minor proportion by weight of higher phosphonated oligomers of maleic acid sold by Albright and Wilson. Dequest 2060 is diethylenetriamine penta(methylenephosphonic acid) sold by Monsanto. Bayhibit AM is 2-phosphonobutane-1,2,4-tricarboxylic acid sold by Bayer. Goodrite K-752 is a polyacrylate sold by B. F. Goodrich.

As can be seen from Table 1, in all cases except for Bricorr 288, the addition or substitution of low levels of NBT synergisticially improves corrosion performance. Such factors as, e.g., particular test conditions may have contributed to the Bricorr 288 result in this case.

TABLE 1 pH 8.6 With 5 mg/l active PESA & 5 mg/l active AA/AHPSE

| mg/l | INHIBITOR (all as actives) | mg/l NBT | EC avg | EC 18 |
|---|---|---|---|---|
| 0 | — | 0 | 58 | 50 |
| 0 | — | 2 | 24 | 24 |
| 0 | — | 5 | 7.7 | 5.5 |
| 20 | L-Tartaric Acid | 0 | 6.2 | 8.5 |
| 20 | L-Tartaric Acid | 2 | 2.6 | 3.2 |
| 20 | L-Tartaric Acid | 5 | 2.7 | 2.7 |
| 15 | HEDP | 0 | 2.5 | 2.0 |
| 10 | HEDP | 0 | 3.0 | 2.1 |
| 7 | HEDP | 3 | 2.2 | 2.2 |
| 15 | Belcor 575 | 0 | 3.8 | 2.8 |
| 10 | Belcor 575 | 0 | 5.6 | 4.6 |
| 7 | Belcor 575 | 3 | 1.7 | 1.2 |
| 15 | Bricorr 288 | 0 | 3.8 | 2.9 |
| 10 | Bricorr 288 | 0 | 4.7 | 4.0 |
| 7 | Bricorr 288 | 3 | 6.2 | 4.4 |
| 15 | Goodrite K-752 | 0 | 25 | 53 |
| 12 | Goodrite K-752 | 3 | 8.8 | 17 |
| 15 | Dequest 2060 | 0 | 4.0 | 3.2 |
| 10 | Dequest 2060 | 0 | 7.3 | 8.8 |
| 7 | Dequest 2060 | 3 | 3.6 | 2.7 |
| 15 | Bayhibit AM | 0 | 6.1 | 5.7 |
| 10 | Bayhibit AM | 0 | 8.1 | 9.1 |
| 7 | Bayhibit AM | 3 | 3.3 | 3.0 |

Example #2

Corrosion results for tests conducted at pH 7.6 with both AA/AHPSE and PESA present are shown in Table 2. Results with AA/AHPSE only are shown in Table 3. In these waters, an EC(18) of 3 mpy or less is considered to be an acceptable corrosion rate for most industrial applications. In some cases shown in Table 3, the corrosion rates with the tetrazolium compound present are not acceptable. However, the synergistic improvement of the combination of first component with the tetrazolium compound is obvious, and one skilled in the art may readily determine both the effective total amount of inhibitor needed as well as the relative proportions of the tetrazolium compound and other component that are needed to obtain the corrosion protection needed for the application of interest.

The trends noted above for results at pH 8.6 are also seen at pH 7.6. Results for tests with Bricorr 288 are shown in graphical form in FIG. 1 to more clearly illustrate the synergistic improvement obtained by utilizing the tetrazolium compound NBT in combination with this material.

Example #3

Corrosion results for tests conducted at pH 6.8 are shown in Table 4. The pattern previously identified holds at this pH also.

TABLE 2 pH 7.6 with 5 mg/l active PESA & 5 mg/l active AA/AHPSE

| mg/l | INHIBITOR (all as actives) | mg/l NBT | EC avg | EC 18 |
|---|---|---|---|---|
| 0 | — | 0 | 67 | 87 |
| 0 | — | 2 | 65 | 73 |
| 0 | — | 2 | 28 | 32 |

TABLE 2-continued pH 7.6 with 5 mg/l active PESA & 5 mg/l active AA/AHPSE

| mg/l | INHIBITOR (all as actives) | mg/l NBT | EC avg | EC 18 |
|---|---|---|---|---|
| 0 | — | 5 | 40 | 36 |
| 10 | Goodrite K-752 | 0 | 19 | 37 |
| 10 | Goodrite K-752 | 2 | 27 | 38 |
| 10 | Goodrite K-752 | 5 | 11 | 12 |
| 20 | Goodrite K-752 | 0 | 11 | 11 |
| 20 | Goodrite K-752 | 2 | 7.4 | 6.9 |
| 20 | Goodrite K-752 | 5 | 1.3 | 0.7 |
| 20 | Goodrite K-732 | 0 | 14 | 23 |
| 25 | Goodrite K-732 | 0 | 7.4 | 8.0 |
| 20 | Goodrite K-732 | 2 | 6.4 | 5.6 |
| 20 | Goodrite K-732 | 5 | 0.9 | 0.4 |
| 20 | 50:50 mix of Goodrite K-752 and K-732 | 0 | 12 | 18 |
| 20 | 50:50 mix of Goodrite K-752 and K-732 | 2 | 7.8 | 8.8 |
| 20 | 50:50 mix of Goodrite K-752 and K-732 | 5 | 1.3 | 0.6 |
| 25 | A | 0 | 15 | 17 |
| 20 | A | 5 | 1.8 | 1.1 |
| 25 | B | 0 | 9.4 | 7.7 |
| 20 | B | 5 | 2.0 | 1.0 |
| 25 | C | 0 | 19 | 19 |
| 20 | C | 5 | 1.1 | 0.5 |
| 5 | ortho-PO4 | 0 | 4.1 | 3.0 |
| 5 | ortho-PO4 | 2 | 0.9 | 0.3 |
| 5 | ortho-PO4 | 5 | 0.8 | 0.4 |
| 20 | Bricorr 288 | 0 | 5.3 | 4.6 |
| 15 | Bricorr 288 | 5 | 1.1 | 0.4 |
| 20 | Bayhibit AM | 0 | 12 | 8.7 |
| 15 | Bayhibit AM | 5 | 2.0 | 0.5 |

A: N,N'-bis(2-hydroxysuccinyl)-6,6-hexanediamine, as Na salt
B: iminodi(2-hydroxysuccinic acid), as Na salt
C: N,N'-bis(2-hydroxy succinyl)-m-xylenediamine, as Na salt

TABLE 3 pH 7.6 with 5 mg/l active AA/AHPSE

| mg/l | INHIBITOR (all as actives) | mg/l NBT | EC avg | EC 18 |
|---|---|---|---|---|
| 0 | — | 3 | 56 | 63 |
| 0 | — | 5 | 59 | 58 |
| 0 | — | 10 | 33 | 19 |
| 0 | — | 15 | 16 | 11 |
| 0 | — | 20 | 10 | 5 |
| 20 | Bricorr 288 | 0 | 5.6 | 5.5 |
| 17 | Bricorr 288 | 3 | 1.8 | 0.4 |
| 15 | Bricorr 288 | 5 | 1.6 | 0.4 |
| 10 | Bricorr 288 | 10 | 0.7 | 0.2 |
| 5 | Bricorr 288 | 15 | 5.8 | 3.2 |
| 10 | Bricorr 288 | 5 | 1.9 | 0.7 |
| 5 | Bricorr 288 | 5 | 20 | 16 |
| 25 | PESA | 0 | 13 | 18 |
| 30 | PESA | 0 | 11 | 13 |
| 10 | PESA | 5 | 13 | 12 |
| 20 | PESA | 5 | 1.8 | 0.8 |
| 30 | PESA | 5 | 1.0 | 1.0 |
| 25 | Citric acid | 0 | 14 | 13 |
| 30 | Citric Acid | 0 | 12 | 14 |
| 10 | Citric Acid | 5 | 21 | 16 |
| 20 | Citric Acid | 5 | 2.3 | 0.9 |
| 30 | Citric Acid | 5 | 1.3 | 0.4 |
| 30 | Goodrite K-732 | 0 | 6.1 | 6 |
| 10 | Goodrite K-732 | 5 | 9.7 | 10 |
| 20 | Goodrite K-732 | 5 | 0.8 | 0.5 |
| 30 | Goodrite K-732 | 5 | 0.7 | 0.3 |
| 25 | Belclene 200 | 0 | 14 | 13 |
| 30 | Belclene 200 | 0 | 14 | 12 |
| 10 | Belclene 200 | 5 | 6.8 | 6.3 |
| 20 | Belclene 200 | 5 | 1.3 | 0.7 |
| 30 | Belclene 200 | 5 | 1.2 | 0.7 |
| 25 | 2,3-Dihydroxybenzoic acid | 0 | 7.7 | 7.0 |
| 20 | 2,3-Dihydroxybenzoic acid | 5 | 0.97 | 0.49 |

TABLE 3-continued pH 7.6 with 5 mg/l active AA/AHPSE

| mg/l | INHIBITOR (all as actives) | mg/l NBT | EC avg | EC 18 |
|---|---|---|---|---|
| 25 | 1,2,3,4-Butanetetracarboxylic acid | 0 | 12 | 23 |
| 20 | 1,2,3,4-Butanetetracarboxylic acid | 5 | 9.3 | 7.5 |
| 75 | Sodium tetraborate (Borax) | 0 | 64 | 77 |
| 70 | Sodium tetraborate (Borax) | 5 | 58 | 51 |
| 30 | Nitrite (from sodium nitrite) | 0 | 59 | 62 |
| 25 | Nitrite (from sodium nitrite) | 5 | 36 | 45 |
| 60 | Nitrite (from sodium nitrite) | 0 | 25 | 41 |
| 55 | Nitrite (from sodium nitrite) | 5 | 11 | 14 |
| 25 | Mesotartaric acid | 0 | 9.4 | 7.7 |
| 20 | Mesotartaric acid | 5 | 1.7 | 0.93 |
| 30 | Gluconic acid | 5 | 3.6 | 2.2 |
| 20 | N-Lauroyl sarcosine | 0 | 46 | 73 |
| 15 | N-Lauroyl sarcosine | 5 | 30 | 30 |
| 25 | 1,10-Phenanthroline | 0 | 59 | 66 |
| 20 | 1,10-Phenanthroline | 5 | 40 | 28 |
| 30 | Belsperse 161 (oligomeric PAA with phosphino groups) | 0 | 5.2 | 4.4 |
| 25 | Belsperse 161 (oligomeric PAA with phosphino groups) | 5 | 1.1 | 0.31 |
| 30 | Low mol. wt. polyacrylic acid (PAA) with phosphonic acid end group, Na salt | 0 | 6.6 | 7.1 |
| 25 | Low mol. wt. PAA with phosphonic acid end group) | 5 | 1.7 | 0.84 |
| 30 | Belclene 500 (Oligomeric PAA with phosphino group) | 0 | 14 | 17 |
| 25 | Belclene 500 (Oligomeric PAA with phosphino group) | 5 | 2.5 | 0.93 |
| 30 | Belclene 400 (AA:AMPS with phosphinate) | 0 | 11 | 10 |
| 25 | Belclene 400 (AA:AMPS with phosphinate) | 5 | 3.3 | 1.2 |
| 30 | Belclene 494 (AA:AMPS with phosphonate end) | 0 | 8.3 | 7.7 |
| 25 | Belclene 494 (AA:AMPS with phosphonate end) | 5 | 7.2 | 7.2 |
| | Polycrylates | | | |
| 25 | Goodrite K-732 | 5 | 1.1 | 0.35 |
| 20 | Goodrite K-752 | 5 | 1.5 | 0.65 |
| 30 | Goodrite K-752 | 5 | 0.96 | 0.43 |
| | Modified Polyexpoxysuccinic acid | | | |
| 25 | m-Xylylenediamine/PESA derivative #1, as Na salt | 5 | 0.98 | 0.48 |
| 25 | m-Xylylenediamine/PESA derivative #2, as Na salt | 5 | 1.7 | 0.62 |
| 25 | m-Xylylenediamine/PESA derivative #3, as Na salt | 5 | 1.7 | 0.72 |
| 25 | m-Xylylenediamine/PESA derivative #4, as Na salt | 5 | 1.8 | 0.73 |

TABLE 4 pH 6.8 With 5 mg/l active PESA & 5 mg/l active AA/AHPSE

| mg/l | INHIBITOR (all as actives) | mg/l NBT | EC avg | EC 18 |
|---|---|---|---|---|
| 0 | — | 0 | 71 | 80 |
| 0 | — | 5 | 67 | 67 |
| 25 | A | 0 | 20 | 20 |
| 20 | A | 5 | 3.7 | 1.5 |
| 25 | B | 0 | 13 | 14 |
| 20 | B | 5 | 2.0 | 0.6 |
| 25 | C | 0 | 21 | 19 |
| 20 | C | 5 | 2.7 | 2.3 |
| 25 | Ketomalonic acid | 0 | 6.2 | 5.3 |
| 20 | Ketomalonic acid | 5 | 2.3 | 1.9 |
| 25 | L-tartaric acid | 0 | 17 | 17 |
| 20 | L-tartaric acid | 5 | 4.3 | 2.0 |
| 25 | Saccharic acid | 0 | 13 | 12 |
| 20 | Saccharic acid | 5 | 2.2 | 0.9 |
| 7 | ortho-$PO_4$ | 0 | 4.5 | 4.1 |

TABLE 4-continued pH 6.8 With 5 mg/l active PESA & 5 mg/l active AA/AHPSE

| mg/l | INHIBITOR (all as actives) | mg/l NBT | EC avg | EC 18 |
|---|---|---|---|---|
| 7 | ortho-$PO_4$ | 2 | 1.4 | 1.0 |
| 7 | ortho-$PO_4$ | 5 | 1.0 | 0.6 |
| 20 | Bricorr 288 | 0 | 5.0 | 6.2 |
| 15 | Bricorr 288 | 5 | 1.3 | 0.5 |
| 20 | HEDP | 0 | 7.3 | 5.9 |
| 15 | HEDP | 5 | 1.0 | 0.6 |
| 20 | Belcor 575 | 0 | 5.7 | 8.5 |
| 15 | Belcor 575 | 5 | 0.7 | 0.6 |
| 20 | molybdate, as $MoO_4$ | 0 | 15 | 33 |
| 15 | molybdate, as $MoO_4$ | 5 | 11 | 12 |
| 30 | molybdate, as $MoO_4$ | 0 | 8.1 | 11 |
| 25 | molybdate, as $MoO_4$ | 5 | 2.8 | 3.1 |
| 25 | Goodrite K-732 | 0 | 8.8 | 8.4 |
| 20 | Goodrite K-732 | 5 | 3.8 | 1.8 |

EFFICACY AT INHIBITING GROWTH OF PITS

Example #4

Pit depth results for varying exposure times for tests at pH 8.6 with tartaric acid are shown in Table 5. As the results show, addition of NBT is very effective at limiting the growth of pits. Pitting is a particular problem for non-phosphorus inhibitors such as tartaric acid.

TABLE 5

Pit Depths as a Function of Immersion Time 20 mg/l Tartaric Acid, pH 8.6 Test With 5 mg/l active PESA and 5 mg/l active AA/AHPSE

| Immersion | ADDITIVE | | |
|---|---|---|---|
| (hours) | None | 2 mg/l NBT | 5 mg/l NBT |
| 18 | 56 | 34 | 18 |
| 42 | 89 | 23 | 21 |
| 66 | 130 | 30 | 30 |
| 90 | 134 | 44 | 30 |

Pit depths in microns; tabulated values are averages

Example #5

Pit depth and pit count data for tests at pH 7.6 with orthophosphate are shown in Table 6. These results show that NBT is effective both at reducing pit depths and pit densities.

TABLE 6

Pit Depth and Count 7 mg/l ortho-PO4, pH 7.6, 18 hour test With 5 mg/l active PESA and 5 mg/l active AA/AHPSE

| | ADDITIVE | | |
|---|---|---|---|
| | None | 2 mg/l NBT | 5 mg/l NBT |
| Depth | 22 | 11 | 9 |
| Pit Count | 80* | 39 | 18 |

Pit depths in microns; tabulated values are averages
*More pits existed but total pit count was not obtained

Example #6

Shown in Table 7 are pitting data obtained at 10 mg/l total added inhibitor which further demonstrate the pit growth inhibiting property of NBT. Although pit densities were higher in the treatments containing NBT, pit depths were significantly lower. The significant impact of NBT on general corrosion rate can clearly be seen in the case of Bayhibit AM.

TABLE 7 pH 8.6 Results with 5 mg/l Copolymer of acrylic acid/ 1-allyloxy-2-hydroxypropane sulfonic acid and 5 mg/l PESA present

| mg/l | Inhibitor (as actives) | mg/l NBT | EC (avg) | EC (18) | Total # pits | Max PD | Avg PD | Min PD |
|---|---|---|---|---|---|---|---|---|
| 10 | HEDP | 0 | 3.0 | 2.1 | 8 | 48 | 42 | 40 |
| 7 | HEDP | 3 | 2.2 | 2.2 | 20 | 23 | 14 | 8 |
| 10 | Bayhibit AM | 0 | 8.1 | 9.1 | 11 | 82 | 58 | 38 |
| 7 | Bayhibit AM | 3 | 3.4 | 3.0 | 20 | 68 | 30 | 7 |

PD = Pit depth measured on coupons at end of test, in microns
Max = maximum depth,
Avg = average depth,
Min = minimum depth

ADDITIONAL EXAMPLES—OTHER TEST WATERS

The hardness and pH of waters in aqueous systems such as cooling towers and the like can vary widely. It is greatly advantageous to have inhibitor formulations which can function effectively over a wide hardness range and pH range while inhibiting both corrosion and deposition. It is of further advantage in certain systems that must use uncycled water which typically has low calcium (<100 mg/l Ca as $CaCO_3$) and is relatively neutral pH (6.5–7.5) that the inhibitors used need not rely on alkaline pH, high hardness conditions to function effectively, as is the case with many of the treatments currently in use. Examples of such systems are closed loop cooling systems once through cooling systems, hot water heating systems, and the like. The following examples further establish the wide-ranging effectiveness of inhibitor formulations containing a tetrazolium compound and the improvement obtained over materials known in the art when a tetrazolium compound is utilized in conjunction with other components described in this disclosure.

Example #7

Low pH, Low Hardness

Table 8 shows results from a water containing 15 mg/l Ca as $CaCO_3$, 7.6 mg/l Mg as $CaCO_3$, 71 mg/l Cl, 48 mg/l $SO_4$, with 5 mg/l active AA/AHPSE at pH 7.0. A significant decrease in corrosion rate is observed when 5 mg/i NBT is added.

TABLE 8

| mg/l | Treatment | mg/l NBT | EC avg | EC (18) |
|---|---|---|---|---|
| 10 | O—$PO_4$ | 0 | 12 | 9.7 |
| 10 | O—$PO_4$ | 5 | 1.2 | 0.67 |
| 20 | Bricorr 288 | 0 | 10 | 9.2 |
| 20 | Bricorr 288 | 5 | 0.96 | 0.21 |
| 20 | HEDP | 0 | 9.1 | 9.0 |
| 20 | HEDP | 5 | 0.89 | 0.13 |
| 20 | Belcor 575 | 0 | 5.9 | 5.8 |
| 20 | Belcor 575 | 5 | 0.51 | 0.21 |
| 15 | EBO | 0 | 14 | 15 |
| 15 | EBO | 5 | 1.1 | 0.55 |
| 30 | Goodrite K-732 | 0 | 6.1 | 6.4 |
| 30 | Goodrite K-732 | 5 | 0.48 | 0.12 |
| 60 | L-Tartaric acid | 0 | 13 | 12 |

TABLE 8-continued

| mg/l | Treatment | mg/l NBT | EC avg | EC (18) |
|---|---|---|---|---|
| 60 | L-Tartaric acid | 5 | 2.4 | 1.2 |
| 20 | Ketomalonic Acid | 0 | 5.3 | 6.3 |
| 20 | Ketomalonic Acid | 5 | 1.1 | 0.70 |
| 20 | Saccharic Acid | 0 | 9.2 | 9.0 |
| 20 | Saccharic Acid | 5 | 2.1 | 1.1 |

O—$PO_4$: orthophosphate
HEDP: Hydroxyethylidene diphosphonic acid

Example #8

Lower pH, Higher Hardness

Results of BCTA tests conducted at pH 6.8 in a water containing 500 mg/l Ca as $CaCO_3$, 250 mg/l Mg as $CaCO_3$, 7 mg/l MAlk as $CaCO_3$, 354 mg/l chloride, and 500 mg/l sulfate are shown in Table 9. All tests contained 5 mg/l active AAIAHPSE. Conditions of this kind are often encountered in open recirculating cooling systems where the source (makeup) water has been concentrated several times due to evaporation and sulfuric acid has been added to maintain relatively low pH. In these series of tests the total inhibitor concentration was kept constant or nearly constant for each pair of comparisons (with and without NBT). In each case, replacement of part of the inhibitor or inhibitor blend with NBT resulted in a significant improvement in corrosion performance. As previously noted, not all combinations with the tetrazolium compound provide acceptable corrosion performance, but the combination in all cases improves performance. One skilled in the art may readily determine the appropriate levels and ratios needed to obtain satisfactory performance in a particular aqueous system.

TABLE 9

| mg/l | Treat #1 | mg/l | Treat #2 | mg/l NBT | EC (avg) | EC (18) |
|---|---|---|---|---|---|---|
| 10 | O—$PO_4$ | — | — | 0 | 7.5 | 5.0 |
| 5 | O—$PO_4$ | — | — | 5 | 2.3 | 1.6 |
| 7 | O—$PO_4$ | 3.0 | Pyro-$PO_4$ | 0 | 2.9 | 1.2 |
| 5.5 | O—$PO_4$ | 2.5 | Pyro-$PO_4$ | 3 | 0.99 | 0.37 |
| 4 | O—$PO_4$ | 2.0 | Pyro-$PO_4$ | 3 | 1.6 | 0.77 |
| 20 | Bricorr 288 | — | — | 0 | 31 | 49 |
| 15 | Bricorr 288 | — | — | 5 | 13 | 13 |
| 16 | Bricorr 288 | 4 | O—$PO_4$ | 0 | 2.6 | 1.6 |
| 12 | Bricorr 288 | 3 | O—$PO_4$ | 5 | 1.5 | 0.92 |
| 25 | Saccharic acid | — | — | 0 | 34 | 60 |
| 20 | Saccharic acid | — | — | 5 | 13 | 11 |
| 15 | Saccharic acid | 4 | O—$PO_4$ | 0 | 7.9 | 8.2 |
| 12 | Saccharic acid | 3 | O—$PO_4$ | 5 | 2.1 | 1.3 |
| 16 | D | 4 | O—$PO_4$ | 0 | 12 | 7.7 |
| 12 | D | 3 | O—$PO_4$ | 5 | 1.9 | 0.89 |

D: imino-di(2-hydroxy succinic acid), as Na salt

Example #9

Higher pH, Moderate Hardness Water

Table 10 shows the results from a pH 8.6 test water that contains 360 mg/l Ca as $CaCO_3$, 180 mg/l Mg as $CaCO_3$, 255 mg/l Cl, 220 mg/l $SO_4$, and 300 mg/l Malk as $CaCO_3$. All tests contain 5 mg/l active AA/AHPSE. Conditions of this kind are often encountered in open recirculating cooling systems where the source (makeup) water has been concentrated several times due to evaporation and the pH has been controlled to be in the mid-pH 8 range to make it easier to control ferrous corrosion. The effectiveness of the addition of a tetrazolium compound under these conditions is apparent from these results.

TABLE 10

| mg/l | Treat #1 | mg/l | Treat #2 | mg/l NBT | EC (avg) | EC (18) |
|---|---|---|---|---|---|---|
| 10 | PESA | — | — | 0 | 11 | 15 |
| 5 | PESA | — | — | 5 | 6.7 | 3.3 |
| 20 | PESA | — | — | 0 | 7.6 | 7.0 |
| 10 | PESA | — | — | 5 | 4.5 | 2.7 |
| 20 | PESA | — | — | 5 | 2.5 | 1.7 |
| 10 | PESA | 10 | L-Tartaric acid | 0 | 7.3 | 4.3 |
| 10 | PESA | 10 | L-Tartaric acid | 5 | 2.5 | 1.9 |
| 10 | Acumer ™ 4210 | — | — | 0 | 11 | 7.8 |
| 10 | Acumer 4210 | — | — | 5 | 3.7 | 1.6 |
| 20 | Acumer 4210 | — | — | 0 | 6.4 | 4.1 |
| 20 | Acumer 4210 | — | — | 5 | 2.2 | 2.0 |
| 10 | Acumer 4210 | 10 | PESA | 0 | 6.4 | 4.3 |
| 10 | Acumer 4210 | 10 | PESA | 5 | 2.6 | 2.0 |
| 10 | Acumer 4210 | 10 | L-Tartaric Acid | 0 | 5.4 | 3.5 |
| 10 | Acumer 4210 | 10 | L-Tartaric Acid | 5 | 1.9 | 1.6 |

Acumer 4210: Polymaleic acid, available from Rohm & Haas

Example #10

ADDITIONAL TETRAZOLIUM COMPOUNDS

Data obtained with NBT and three additional tetrazolium compounds: Distyryl Nitroblue Tetrazolium Chloride (DNBT), Tetranitro Blue Tetrazolium Chloride (TNBT), and 2-(4-Iodophenyl)-3-(4-nitrophenyl)-5-phenyltetrazolium chloride (INT) at pH 7.6 are shown in Table 11. The test water is the same as for Example 2. Other than the DNBT combination with Belclene 200, the synergistic interaction of the combination of a tetrazolium compound with other materials disclosed in this invention is evident.

TABLE 11

| INHIBITOR (all as actives) | mg/l | Tetrazolium compound | mg/l | EC avg | EC 18 |
|---|---|---|---|---|---|
| — | — | DNBT | 25 | 15 | 13 |
| — | — | TNBT | 25 | 12 | 9.0 |
| — | — | INT | 25 | 9.0 | 5.7 |
| — | — | NBT | 20 | 10 | 5 |
| Bricorr 288 | 25 | — | — | 4.4 | 4.2 |
| Bricorr 288 | 20 | DNBT | 5 | 1.5 | 0.9 |
| Bricorr 288 | 20 | TNBT | 5 | 1.1 | 0.8 |
| Bricorr 288 | 20 | INT | 5 | 4.0 | 3.7 |
| Bricorr 288 | 15 | NBT | 5 | 1.6 | 0.4 |
| Belclene 200 | 25 | — | — | 15 | 13 |
| Belclene 200 | 20 | DNBT | 5 | 21 | 22 |
| Belclene 200 | 20 | TNBT | 5 | 5.5 | 5.2 |
| Belclene 200 | 20 | INT | 5 | 6.7 | 11 |
| Belclene 200 | 20 | NBT | 5 | 1.3 | 0.7 |

While this invention has been described with respect to particular embodiments thereof, it is apparent that numerous other forms and modifications of this invention will be obvious to those skilled in the art. The appended claims and this invention generally should be construed to cover all such obvious forms and modifications which are within the. true spirit and scope of the present invention.

We claim:

1. A method for controlling the corrosion of metals in contact with an aqueous system at a pH of about 5 to about 12 which comprises introducing into said system a combination of:

(a) a tetrazolium compound of the formula:

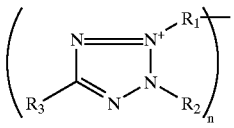

wherein $R_1$, $R_2$ and $R_3$ are selected from the group consisting of lower alkyl, branched lower alkyl, aryl, substituted aryl, alkylaryl, substituted alkyaryl and heterocyclic substituted aryl, with the proviso that neither $R_1$, $R_2$, or $R_3$ contain more than 14 carbon atoms; and n is 1 or 2, such tetrazolium compound optionally having associated water soluble ionic species if needed to obtain a neutral charge, and (b) at least one other aqueous system treatment material chosen so that the material does not substantially reduce the tetrazolium compound selected from the group consisting of inorganic phosphates; nitrites; compounds that release a metal anion in water; 2,3-dihydroxybenzoic acid; 1,10-phenanthroline; polycarboxylates; alkyl hydroxylcarboxylate acids; aminohydroxysuccinic acids; carboxyamines; polyepoxysuccinic acids; modified polyepoxysuccinic acids; monophosphonic acids; diphosphonic acids; phosphonocarboxylic acids; hydroxyphosphonocarboxylic acids; aminophosphonic acids; phosphonomethylamine oxides; polymeric amine oxides; polyetherpolyaminomethylene phosphonates; polyetherpolyamino-methylene phosphonate N-oxides; long chain fatty acids derivatives of sarcosine; telomeric, co-telomeric, polymeric or copolymeric phosphorus-containing carboxylates; amines; diamines; alkanolamines; fatty amines and diamines; quaternized amines; oxyalkylated amines; alkyl pyridines; benzoates; substituted benzoates; straight chain $C_5$–$C_{11}$ monocarboxylates; $C_4$–$C_{15}\alpha,\omega$-dicarboxylates; amine salts of carboxylic acids; mercaptocarboxylic acids; amino acids; polyamino acids; dicarboxylic acids; tricarboxylic acids; phosphoesters; phosphate esters; water soluble salts thereof and mixtures thereof, wherein the weight ratio of component (b) to component (a) is from about 100:1 to about 1:20.

2. A method as recited in claim 1 wherein said tetrazolium compound is selected from the group consisting of the water soluble salts of Nitro Blue Tetrazolium (2,2'-Di-p-nitrophenyl-5,5'-distyryl-3,3'-[3,3'-dimethoxy-4,4'-biphenylene]ditetrazolium), Distyryl Nitroblue Tetrazolium (2,2'-Di-p-nitrophenyl-5,5'-distyryl-3,3'-[3,3'-dimethoxy-4,4'-biphenylene]ditetrazolium), Tetranitro Blue Tetrazolium (3,3'-(3,3'-Dimethoxy-4,4'-biphenylene)-bis-[2,5-p-nitrophenyl-2H-tetrazolium) and Iodonitro Tetrazolium (2-(4-Iodophenyl)-3-(4-nitrophenyl)-5-phenyltetrazolium).

3. A method as recited in claim 1 wherein said tetrazolium compound is selected from the group consisting of the water soluble salts of Nitro Blue Tetrazolium (2,2'-Di-p-nitrophenyl-5,5'-distyryl-3,3'-[3,3'-dimethoxy-4,4'-biphenylene]ditetrazolium), Distyryl Nitroblue Tetrazolium (2,2'-Di-p-nitrophenyl-5,5'-distyryl-3,3'-[3,3'-dimethoxy-4,4'-biphenylene]ditetrazolium), Tetranitro Blue Tetrazolium (3,3'-(3,3'-Dimethoxy-4,4'-biphenylene)-bis-[2,5-p-nitrophenyl-2H-tetrazolium) and Iodonitro Tetrazolium (2-(4-Iodophenyl)-3-(4-nitrophenyl)-5-phenyltetrazolium).

4. A method as recited in claim 1 wherein said water soluble ionic species are anions selected from the group consisting of halogens, nitrates, nitrites, carbonates, bicarbonates, sulfates, phosphates, and transition metal oxygenates.

5. A method as recited in claim 4 wherein said halogens are selected from the group consisting of chlorides, fluorides, bromides and iodides.

6. A method as recited in claim 5 wherein said halogen is chloride.

7. A method as recited in claim 4 wherein said transition metal oxygenate is selected from the group consisting of molybdate, chromate, and tungstate.

8. A method as recited in claim 7 wherein said transition metal oxygenate is molybdate.

9. A method as recited in claim 1 wherein said inorganic phosphates are orthophosphates, polyphosphates, water soluble salts thereof and mixtures thereof.

10. A method as recited in claim 1 wherein said inorganic phosphates are a mixture of orthophosphoric acid and pyrophosphoric acid or the water-soluble salts thereof.

11. A method as recited in claim 1 wherein said nitrite is sodium nitrite.

12. A method as recited in claim 1 wherein the metal anion releasing compounds are selected from the group consisting of the water soluble salts of molybdate, tungstate, vanadate, metavanadate, and chromate.

13. A method as recited in claim 12 wherein the water soluble salt of a molybdate is sodium molybdate or a hydrate of sodium molybdate.

14. A method as recited in claim 1 wherein said polycarboxylates comprise aliphatic compounds containing between about 4 and about 20 carbon atoms which are multiply substituted with carboxylate groups or water soluble salts thereof.

15. A method as recited in claim 14 wherein said polycarboxylate is 1,2,3,4-butanetetracarboxylic acid.

16. A method as recited in claim 1 wherein said polycarboxylate is a homopolymer obtained from the polymerization of an ethylenically unsaturated monomer containing one or more carboxyl groups.

17. A method as recited in claim 16 wherein said homopolymer is polyacrylic acid or its water soluble salts.

18. A method as recited in claim 16 wherein said homopolymer is polymaleic acid or its water soluble salts.

19. A method as recited in claim 16 wherein said homopolymer is polymaleic anhydride or its water soluble salts.

20. A method as recited in claim 1 wherein said polycarboxylate is a copolymer obtained from the polymerization of two or more different ethylenically unsaturated monomers, each of said monomers containing one or more carboxyl groups.

21. A method as recited in claims 1 wherein said alkyl hydroxycarboxylic acid has the generalized formula:

$$HOOC—(R_{B1})_a—(R_{B2})_b—(R_{B3})_c—R_{B4}$$

where a, b, and c are integers from 0 to 6 and (a+b+c)>0 where $R_{B1}$, $R_{B2}$, $R_{B3}$ comprise C═O or CYZ, where Y and Z are separately selected from the group of H, OH, CHO, COOH, $CH_3$, $CH_2(OH)$, $CH(OH)_2$, $CH_2(COOH)$, CH(OH)COOH, $CH_2(CHO)$ and CH(OH)CHO, so selected that the molecule has a minimum of one OH group when written in its fully hydrated form and $R_{B4}$ is either H or COOH, including the various stereoisomers and chemically equivalent cyclic, dehydrated, and hydrated forms of these acids and hydrolyzable esters and acetals that form the above compounds in water or the water soluble salts of such alkyl hydroxycarboxylic acids.

22. A method as recited in claim 21 wherein said alkyl hydroycarboxylic acid is chosen from the group consisting of tartaric acid, mesotartaric acid, citric acid, gluconic acid, glucoheptonic acid, ketomalonic acid, saccharic acid and the water soluble salts thereof.

23. A method as recited in claim 1 wherein the said other aqueous system treatment materials is a mixture of orthophosphoric acid or its water-soluble salts and at least one alkyl hydroxycarboxylic acid having the generalized formula:

$$HOOC—(R_{B1})_a—(R_{B2})_b—(R_{B3})_c—R_{B4}$$

where a, b, and c are integers from 0 to 6 and (a+b+c)>0 where $R_{B1}$, $R_{B2}$, $R_{B3}$ comprise C═O or CYZ, where Y and Z are separately selected from the group of H, OH, CHO, COOH, $CH_3$, $CH_2(OH)$, $CH(OH)_2$, $CH_2(COOH)$, CH(OH)COOH, $CH_2(CHO)$ and CH(OH)CHO, so selected that the molecule has a minimum of one OH group when written in its fully hydrated form and $R_{B4}$ is either H or COOH, including the various stereoisomers and chemically equivalent cyclic, dehydrated, and hydrated forms of these acids and hydrolyzable esters and acetals that form the above compounds in water or the water soluble salts of such alkyl hydroxycarboxylic acids, and the water soluble salts thereof.

24. A method as recited in claim 23 wherein the hydroxycarboxylic acid is selected from the group consisting of tartaric acid, mesotartaric acid, citric acid, gluconic acid, glucoheptonic acid, ketomalonic acid, saccharic acid and the water soluble salts thereof.

25. A method as recited in claim 1 wherein said aminohydroxysuccinic acid has the generalized formula:

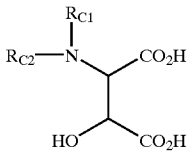

wherein $R_{C1}$ is H or $C_1$ to $C_4$ alkyl, optionally substituted with —OH, $—CO_2H$, $—SO_3H$, or phenyl, $C_4$ to $C_7$ cycloalkyl, or phenyl which is optionally substituted with —OH or $—CO_2H$, and $R_{C2}$ is H, $C_1$ to $C_6$ alkyl, optionally substituted with —OH or $—CO_2H$ (specifically including the moiety $—CH(CO_2H)CH(OH)(CO_2H)$); and

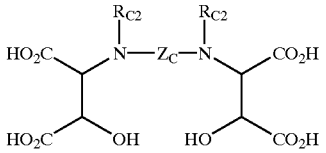

wherein $R_{C2}$ is as above, and $Z_C$ is selected from the group consisting of i) $—(CH_2)_k—$ wherein k is an integer from 2 to 10, ii) $—(CH_2)—X_C—(CH_2)_2—$ wherein $X_C$ is —O—, —S—, $—NR_{C3}—$, wherein $R_{C3}$ is selected from the group consisting of H, $C_1$ to $C_6$ alkyl, hydroxyalkyl, carboxyalkyl, acyl, $(O)OR_{C4}$ wherein $R_{C4}$ is selected from the group consisting of $C_1$ to $C_6$ alkyl or benzyl and a residue having the general formula:

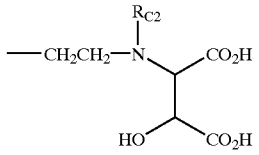

wherein $R_{C2}$ is as above, iii) a residue having the generalized formula:

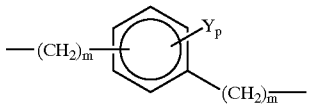

wherein Y is H, $C_1$ to $C_6$ alkyl, alkoxy, halogen, $—CO_2H$, $—SO_3H$, m is independently 0 or 1, and p is 1 or 2, and iv) a residue having the generalized formula:

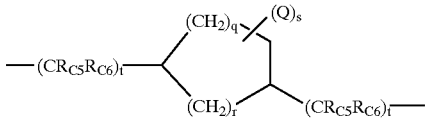

wherein $R_{C5}$ and $R_{C6}$ are independently H or $C_1$ to $C_6$ alkyl, Q is H or $C_1$ to $C_6$ alkyl, s is 0, 1 or 2, t is independently 0, 1, 2, or 3, q is 0, 1, 2, or 3, and r is 1 or 2 or water soluble salts thereof.

26. A method as recited in claim 25 wherein the aminohydroxysuccinic acid is selected from the group consisting of iminodi(2-hydroxysuccinic acid), N,N'-Bis(2-hydroxysuccinyl)-1,6-hexanediamine, N,N'-Bis(2-hydroxysuccinyl)-m-xylylenediamine, or the water-soluble salts thereof.

27. A method as recited in claim 1 wherein said other aqueous system treatment material is a mixture of orthophosphoric acid or its water-soluble salts and at least one aminohydroxysuccinic acid wherein said aminohydroxysuccinic acid has the generalized formula:

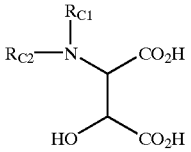

wherein $R_{C1}$ is H or $C_1$ to $C_4$ alkyl, optionally substituted with —OH, $—CO_2H$, $—SO_3H$, or phenyl, $C_4$ to $C_7$ cycloalkyl, or phenyl which is optionally substituted with —OH or $—CO_2H$, and $R_{C2}$ is H, $C_1$ to $C_6$ alkyl, optionally substituted with —OH or $—CO_2H$ (specifically including the moiety $—CH(CO_2H)CH(OH)(CO_2H)$); and

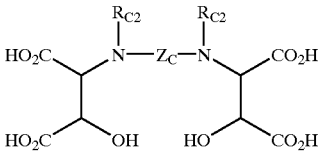

wherein $R_{C2}$ is as above, and $Z_C$ is selected from the group consisting of i) $—(CH_2)_k—$ wherein k is an integer from 2 to 10, ii) $—(CH_2)_2—X_C—(CH_2)_2—$ wherein $X_C$ is —O—, —S—, $—NR_{C3}—$, wherein $R_{C3}$ is selected from the group consisting of H, $C_1$ to $C_6$ alkyl, hydroxyalkyl, carboxyalkyl, acyl, $—C(O)OR_{C4}$ wherein $R_{C4}$ is selected from the group consisting of $C_1$ to $C_6$ alkyl or benzyl and a residue having the general formula:

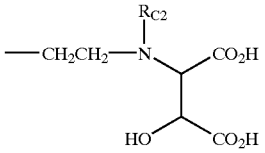

wherein $R_{C2}$ is as above, a residue having the generalized formula:

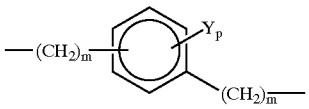

wherein Y is H, $C_1$ to $C_6$ alkyl, alkoxy, halogen, —$CO_2H$, —$SO_3H$, m is independently 0 or 1, and p is 1 or 2, and a residue having the generalized formula:

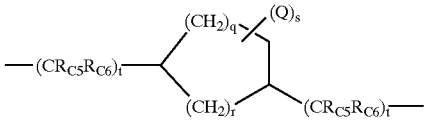

wherein $R_{C5}$ and $R_{C6}$ are independently H or $C_1$ to $C_6$ alkyl, Q is H or $C_1$ to $C_6$ alkyl, s is 0, 1 or 2, t is independently 0, 1, 2, or 3, q is 0, 1, 2, or 3, and r is 1 or 2 or water soluble salts thereof.

28. A method as recited in claim 27 wherein the aminohydroxysuccinic acid is selected from the group consisting of iminodi(2-hydroxysuccinic acid), N,N'-Bis(2-hydroxysuccinyl)-1,6-hexanediamine, N,N'-Bis(2-hydroxysuccinyl)-m-xylylenediamine, or the water-soluble salts thereof.

29. A method as recited in claim 1 wherein the polyepoxysuccinic acid has the generalized formula:

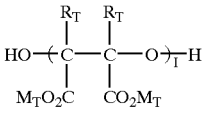

where l ranges from about 2 to about 50, $M_T$ is hydrogen or a water soluble cation such as $Na^+$, $NH_4^+$, or $K^+$ and $R_T$ is hydrogen, $C_{1-4}$ alkyl or $C_{1-4}$ substituted alkyl.

30. A method as recited in claim 29 wherein $R_T$ is hydrogen and l ranges from about 2 to about 10.

31. A method as recited in claim 29 wherein $R_T$ is hydrogen and l is from about 4 to about 7.

32. A method as recited in claim 1 wherein the said other aqueous system treatment material is a mixture of orthophosphoric acid or its water-soluble salts and a polyepoxysuccinic acid having the generalized formula:

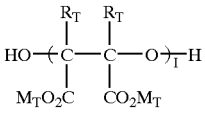

where l ranges from about 2 to about 50, $M_T$ is hydrogen or a water soluble cation such as $Na^+$, $NH_4^+$, or $K^+$ and $R_T$ is hydrogen, $C_{1-4}$ alkyl or $C_{1-4}$ substituted alkyl, or the water soluble salts thereof.

33. A method as recited in claim 32 wherein said polyepoxysuccinic acid has $R_T$ as hydrogen and l is from about 2 to about 10.

34. A method as recited in claim 32 wherein said polyepoxysuccinic acid has $R_T$ as hydrogen and l is from about 4 to about 7.

35. A method as recited in claim 1 wherein the modified polyepoxysuccinic acid has the generalized formula:

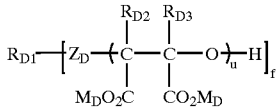

wherein $R_{D1}$, when present, is H, a substituted or non-substituted alkyl or aryl moiety having a carbon chain up to the length where solubility in aqueous solution is lost, or a repeat unit obtained after polymerization of an ethylenically unsaturated compound; $R_{D2}$ and $R_{D3}$ each independently are H, $C_1$ to $C_4$ alkyl or $C_1$ to $C_4$ substituted alkyl; $Z_D$ is O, S, NH, or $NR_{D1}$, where $R_{D1}$ is as described above, n is a positive integer greater than 1; f is a positive integer; and $M_D$ is H, a water soluble cation (e.g., $NH_4^+$, alkali metal), or a non-substituted lower alkyl group having from 1 to 3 carbon atoms (when $R_{D1}$ is not present, $Z_D$ may be $M_DO_3S$, where $M_D$ is as described above).

36. A method as recited in claim 35 wherein $R_{D1}$ is the metaxylylene moiety (meta-$CH_2$—$C_6H_4$—$CH_2$—), $R_{D2}$ and $R_{D3}$ are both H, $Z_D$ is —NH, $M_D$ is Na or H, and f=2, and u is a positive integer greater than 1.

37. The method as recited in claim 1 wherein said monophosphonic acid has the generalized formula:

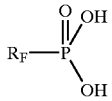

wherein $R_F$ is a $C_1$ to $C_{12}$ straight or branched chain alkyl residue, a $C_2$ to $C_{12}$ straight or branched chain alkenyl residue, a $C_5$ to $C_{12}$ cycloalkyl residue, a $C_6$ to $C_{10}$ aryl residue, or a $C_7$ to $C_{12}$ aralkyl residue, and where $R_F$ may additionally be singly or multiply substituted with groups independently chosen from hydroxyl, amino, or halogen, or the water soluble salts thereof.

38. A method as recited in claim 1 wherein said diphosphonic acid has the generalized formula:

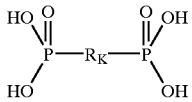

wherein $R_K$ is a $C_1$ to $C_{12}$ straight or branched chain alkylene residue, a $C_2$ to $C_{12}$ straight or branched chain alkenylene residue, a $C_5$ to $C_{12}$ cycloalkylene residue, a $C_6$ to $C_{10}$ arylene residue, or a $C_7$ to $C_{12}$ aralkylene residue where $R_K$ may additionally be singly or multiply substituted with groups independently chosen from hydroxyl, amino, or halogen, or the water soluble salts thereof.

39. A method as recited in claim 38 wherein said diphosphonic acid is 1-hydroxyethane-1,1-diphosphonic acid or the water soluble salts thereof.

40. A method as recited in claim 1 wherein said phosphonocarboxylic acid has the generalized formulas:

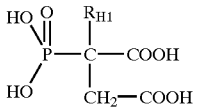

and

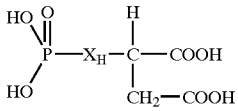

where $R_{H1}$ is H, alkyl, alkenyl, or alkinyl radical having 1 to 4 carbon atoms, an aryl, cycloalkyl, or aralkyl radical, or the radical selected from the following:

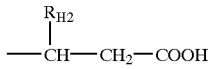

and

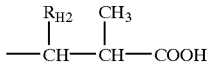

where $R_{H2}$ is H, alkyl radical of 1 to 4 carbon atoms, or a carboxyl radical; and $X_H$ is selected from the following:

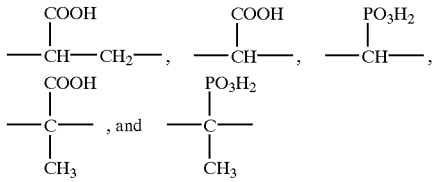

and where the $—PO_3H_2$ group is the phosphono group

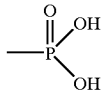

and the water-soluble salts thereof.

41. A method as recited in claim 40 wherein said phosphonocarboxylic acid is 2-phosphonobutane-1,2,4-tricarboxylic acid or the water soluble salts thereof.

42. A method as recited in claim 1 wherein said hydroxyphosphonocarboxylic acid has the generalized formula:

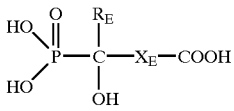

wherein $R_E$ is H, a $C_1$ to $C_{12}$ straight or branched chain alkyl residue, a $C_2$ to $C_{12}$ straight or branched chain alkenyl residue, a $C_5$ to $C_{12}$ cycloalkyl residue, a $C_6$ to $C_{10}$ aryl residue, or a $C_7$ to $C_{12}$ aralkyl residue, $X_E$ is an optional group, which when present is a $C_1$ to $C_{10}$ straight or branched chain alkylene residue, a $C_2$ to $C_{10}$ straight or branched chain alkenylene residue, or a $C_6$ to $C_{10}$ arylene residue or water soluble salts thereof.

43. A method as recited in claim 42 wherein said hydroxyphosphonocarboxylic acid is 2-hydroxy-phosphonoacetic acid or the water soluble salts thereof.

44. A method as recited in claim 1 wherein said aminophosphonic acid has the generalized formula:

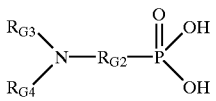

where $R_{G2}$ is a lower alkylene having from about one to about four carbon atoms, or an amine, hydroxy, or halogen substituted lower alkylene; $R_{G3}$ is $R_{G2}—PO_3H_2$, H, OH, amino, substituted amino, or $R_F$, where $R_F$ is a $C_1$ to $C_{12}$ straight or branched chain alkyl residue, a $C_2$ to $C_{12}$ straight or branched chain alkenyl residue, a $C_5$ to $C_{12}$ cycloalkyl residue, a $C_6$ to $C_{10}$ aryl residue, or a $C_7$ to $C_{12}$ aralkyl residue, and where $R_F$ may additionally be singly or multiply substituted with groups independently chosen from hydroxyl, amino, or halogen, $R_{G4}$ is $R_{G3}$ or the group represented by the generalized formula:

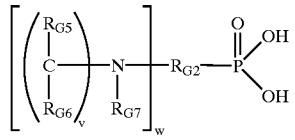

where $R_{G5}$ and $R_{G6}$ are each independently chosen from H, OH, amino, substituted amino, or $R_F$ as previously defined; $R_{G7}$ is $R_{G5}$, $R_{G6}$, or the group $R_{G2}—PO_3H_2$ with $R_{G2}$ as previously defined; v is an integer from 1 to about 15; and w is an integer from 1 through about 14 or water soluble salts thereof.

45. A method as recited in claim 44 wherein said aminophosphonic acid is diethylenetriamine penta (methylenephosphonic acid) or the water soluble salts thereof.

46. A method as recited in claim 1 wherein said phosphonomethyl amine oxide has the generalized formula:

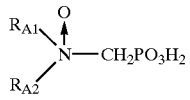

wherein either $R_{A1}$ is selected from the group consisting of hydrocarbyl, and hydroxy-substituted, alkoxy-substituted, carboxyl-substituted and sulfonyl-substituted hydrocarbyl; and $R_{A2}$ is selected from the group consisting of hydrocarbyl, and hydroxy-substituted, alkoxy-substituted, carboxyl-substituted and sulfonyl-substituted hydrocarbyl, $H_2PO_3H_2$, and

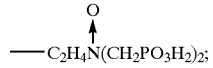

or $R_{A1}$ and $R_{A2}$ together form an alicyclic ring having 3 to 5 carbon atoms in the ring or a water-soluble salt of said phosphonomethyl amine oxide, hydrocarbyl includes alkyl, aryl, and alkaryl groups which do not render the amine oxide insoluble in water.

47. A method as recited in claim 46 wherein said phosphonomethyl amine oxide is N,N-bis-phosphonomethylethanolamine N-oxide or the water soluble salts thereof.

48. A method as recited in claim 1 wherein said phosphorus-containing carboxylate is an oligomer, polymer, co-oligomer, or copolymer obtained from the polymerization of one or more unsaturated monomers in the presence of a phosphorus containing compound, said monomers containing one or more carboxyl groups or containing one or more groups that have been transformed after polymerization into carboxyl groups, and in which the resulting phosphorus containing carboxylate contains phosphorus incorporations that are predominantly or exclusively present as end-type phosphino species or the water soluble salts thereof.

49. A method as recited in claim 1 wherein said phosphorus-containing carboxylate is an oligomer, polymer, co-oligomer, or copolymer obtained from the polymerization of one or more unsaturated monomers in the presence of a phosphorus containing compound, said monomers containing one or more carboxyl groups or containing one or more groups that have been transformed after polymerization into carboxyl groups, and in which the resulting phosphorus containing carboxylate contains phosphorus incorporations that are predominantly or exclusively present as phosphono species or the water soluble salts thereof.

50. A method as recited in claim 1 wherein said phosphorus-containing carboxylate is an oligomer, polymer, co-oligomer, or copolymer obtained from the polymerization of one or more unsaturated monomers in the presence of a phosphorus containing compound, said monomers containing one or more carboxyl groups or containing one or more groups that have been transformed after polymerization into carboxyl groups, and in which the resulting phosphorus-containing carboxylate contains phosphorus incorporations that are predominantly or exclusively present as dialkylphosphino species or the water soluble salts thereof.

51. A method as recited in claim 1 wherein said phosphorus-containing carboxylate is an oligomer, polymer, co-oligomer, or copolymer obtained from the polymerization of one or more unsaturated monomers in the presence of a phosphorus containing compound, said monomers containing one or more carboxyl groups or containing one or more groups that have been transformed after polymerization into carboxyl groups and in which the resulting phosphorus-containing carboxylate contains phosphorus incorporations which are present as a mix of phosphono, end-type phosphino, and dialkylphosphino species or the water soluble salts thereof.

52. A method as recited in claim 48 wherein said unsaturated monomers are chosen from the group consisting of acrylic acid, maleic acid, maleic anhydride, methacrylic acid, itaconic acid, crotonic acid, vinyl acetic acid, fumaric acid, citraconic acid, mesaconic acid, acrylonitrile, methacrylonitrile, alpha-methylene glutaric acid, cyclohexenedicarboxylic acid, cis-1,2,3,6-tetrahydrophthalic anhydride, 3,6-epoxy-1,2,3,6-tetrahydrophthalic anhydride, 5-norbomene-2,3-dicarboxylic anhydride, bicyclo[2.2.2]-5-octene-2,3-dicarboxylic anhydride, 3-methyl-1,2,6-tetrahydrophthalic anhydride, and 2-methyl-1,3,6-tetrahydrophthalic anhydride.

53. A method as recited in claim 48 wherein acrylic acid is the sole unsaturated monomer.

54. The method as recited in claim 48 wherein the sole unsaturated monomer is selected from the group consisting of maleic acid, itaconic acid, and maleic anhydride.

55. A method as recited in claim 48 wherein one unsaturated monomer is acrylic acid and the other unsaturated monomer is selected from the group consisting of maleic acid, itaconic acid, and maleic anhydride.

56. A method as recited in claim 49 wherein said unsaturated monomers are selected from the group consisting of acrylic acid, maleic acid, maleic anhydride, methacrylic acid, itaconic acid, crotonic acid, vinyl acetic acid, fumaric acid, citraconic acid, mesaconic acid, acrylonitrile, methacrylonitrile, alpha-methylene glutaric acid, cyclohexenedicarboxylic acid, cis-1,2,3,6-tetrahydrophthalic anhydride, 3,6-epoxy-1,2,3,6-tetrahydrophthalic anhydride, 5-norbomene-2,3-dicarboxylic anhydride, bicyclo[2.2.2]-5-octene-2,3-dicarboxylic anhydride, 3-methyl-1,2,6-tetrahydrophthalic anhydride, and 2-methyl-1,3,6-tetrahydrophthalic anhydride.

57. A method as recited in claim 49 wherein acrylic acid is the sole unsaturated monomer.

58. A method as recited in claim 49 wherein the sole unsaturated monomer is selected from the group consisting of maleic acid, itaconic acid, and maleic anhydride.

59. A method as recited in claim 49 wherein one unsaturated monomer is acrylic acid and the other unsaturated monomer is selected from the group consisting of maleic acid, itaconic acid, and maleic anhydride.

60. A method as recited in claim 50 wherein said unsaturated monomers are selected from the group consisting of acrylic acid, maleic acid, maleic anhydride, methacrylic acid, itaconic acid, crotonic acid, vinyl acetic acid, fumaric acid, citraconic acid, mesaconic acid, acrylonitrile, methacrylonitrile, alpha-methylene glutaric acid, cyclohexenedicarboxylic acid, cis-1,2,3,6-tetrahydrophthalic anhydride, 3,6-epoxy-1,2,3,6-tetrahydrophthalic anhydride, 5-norbomene-2,3-dicarboxylic anhydride, bicyclo[2.2.2]-5-octene-2,3-dicarboxylic anhydride, 3-methyl-1,2,6-tetrahydrophthalic anhydride, and 2-methyl-1,3,6-tetrahydrophthalic anhydride.

61. A method as recited in claim 50 wherein acrylic acid is the sole unsaturated monomer.

62. A method as recited in claim 50 wherein the sole unsaturated monomer is selected from the group consisting of maleic acid, itaconic acid, and maleic anhydride.

63. A method as recited in claim 50 wherein one unsaturated monomer is acrylic acid and the other unsaturated monomer is selected from the group consisting of maleic acid, itaconic acid, and maleic anhydhide.

64. A method as recited in claim 51 wherein said unsaturated monomers are selected from the group consisting of acrylic acid, maleic acid, maleic anhydride, methacrylic acid, itaconic acid, crotonic acid, vinyl acetic acid, fumaric acid, citraconic acid, mesaconic acid, acrylonitrile, methacrylonitrile, alpha-methylene glutaric acid, cyclohexenedicarboxylic acid, cis-1,2,3,6-tetrahydrophthalic anhydride, 3,6-epoxy-1,2,3,6-tetrahydrophthalic anhydride, 5-norbomene-2,3-dicarboxylic anhydride, bicyclo[2.2.2]-5-octene-2,3-dicarboxylic anhydride, 3-methyl-1,2,6-tetrahydrophthalic anhydride, and 2-methyl-1,3,6-tetrahydrophthalic anhydride.

65. A method as recited in claim 51 wherein acrylic acid is the sole unsaturated monomer.

66. A method as recited in claim 51 wherein the sole unsaturated monomer is selected from the group consisting of maleic acid, itaconic acid, and maleic anhydride.

67. A method as recited in claim 51 wherein one unsaturated monomer is acrylic acid and the other unsaturated monomer is selected from the group consisting of maleic acid, itaconic acid, and maleic anhydride.

68. A method as recited in claim 1 wherein said phosphorus-containing carboxylate is a co-oligomer or copolymer obtained from the polymerization of two or more unsaturated monomers in the presence of a phosphorus containing compound, a major proportion of residues (more than 50% by weight) of the phosphorus-containing carboxylate being derived from carboxyl monomers which contain one or more carboxyl groups or which contain one or more groups that have been transformed after polymerization into carboxyl groups, the remaining residues being obtained from non-carboxyl monomers, and in which the resulting phosphorus-containing carboxylate contains phosphorus incorporations that are predominantly or exclusively present as end-type phosphino species or the water soluble salts thereof.

69. A method as recited in claim 68 wherein the non-carboxyl monomers are selected from the group consisting of 2-acrylamido-2-methylpropanesulfonic, 2-hydroxy-3-(2-propenyloxy)propanesulfonic acid, 2-methyl-2-propene-1-sulfonic acid, allylsulfonic acid, allyloxybenzenesulfonic acid, styrenesulfonic acid, vinylsulfonic acid, allylphosphonic acid, vinylphosphonic acid, isopropenylphosphonic acid, phosphoethyl methacrylate, hydroxyalkyl and $C_1$–$C_4$ alkyl esters of acrylic or methacrylic acid, acrylamides, alkyl substituted acrylamides, allyl alcohol, 2-vinyl pyridine, 4-vinyl pyridine, N-vinylpyrrolidone, N-vinylformamide, N-vinylimidazole, vinyl acetate, hydrolyzed vinyl acetate, and styrene.

70. A method as recited in claim 68 wherein said carboxyl monomers are selected from the group consisting of acrylic acid, maleic acid, maleic anhydride, methacrylic acid, itaconic acid, crotonic acid, vinyl acetic acid, fumaric acid, citraconic acid, mesaconic acid, acrylonitrile, methacrylonitrile, alpha-methylene glutaric acid, cyclohexenedicarboxylic acid, cis-1,2,3,6-tetrahydrophthalic anhydride, 3,6-epoxy-1,2,3,6-tetrahydrophthalic anhydride, 5-norbomene-2,3-dicarboxylic anhydride, bicyclo[2.2.2]-5-octene-2,3-dicarboxylic anhydride, 3-methyl-1,2,6-tetrahydrophthalic anhydride, and 2-methyl-1,3,6-tetrahydrophthalic anhydride.

71. A method as recited in claim 70 wherein the carboxyl monomer is selected from the group consisting of acrylic acid, maleic acid, itaconic acid, and maleic anhydride.

72. A method as recited in claim 1 wherein said a phosphorus-containing carboxylate is a co-oligomer or copolymer obtained from the polymerization of two or more unsaturated monomers in the presence of a phosphorus containing compound, a major proportion of residues (more than 50% by weight) of the phosphorus-containing carboxylate being derived from carboxyl monomers which contain one or more carboxyl groups or which contain one or more groups that have been transformed after polymerization into carboxyl groups, the remaining residues being obtained from non-carboxyl monomers, and in which the resulting phosphorus-containing carboxylate contains phosphorus incorporations that are predominantly or exclusively present as phosphono species or the water soluble salts thereof.

73. A method as recited in claim 72 wherein the non-carboxyl monomers are chosen from the group consisting of 2-acrylamido-2-methylpropanesulfonic, 2-hydroxy-3-(2-propenyloxy)propanesulfonic acid, 2-methyl-2-propene-1-sulfonic acid, allylsulfonic acid, allyloxybenzenesulfonic acid, styrenesulfonic acid, vinylsulfonic acid, allylphosphonic acid, vinylphosphonic acid, isopropenylphosphonic acid, phosphoethyl methacrylate, hydroxyalkyl and $C_1$–$C_4$ alkyl esters of acrylic or methacrylic acid, acrylamides, alkyl substituted acrylamides, allyl alcohol, 2-vinyl pyridine, 4-vinyl pyridine, N-vinylpyrrolidone, N-vinylformamide, N-vinylimidazole, vinyl acetate, hydrolyzed vinyl acetate, and styrene.

74. A method as recited in claim 72 wherein said carboxyl monomers are chosen from the group consisting of acrylic acid, maleic acid, maleic anhydride, methacrylic acid, itaconic acid, crotonic acid, vinyl acetic acid, fumaric acid, citraconic acid, mesaconic acid, acrylonitrile, methacrylonitrile, alpha-methylene glutaric acid, cyclohexenedicarboxylic acid, cis-1,2,3,6-tetrahydrophthalic anhydride, 3,6-epoxy-1,2,3,6-tetrahydrophthalic anhydride, 5-norbomene-2,3-dicarboxylic anhydride, bicyclo[2.2.2]-5-octene-2,3-dicarboxylic anhydride, 3-methyl-1,2,6-tetrahydrophthalic anhydride, and 2-methyl-1,3,6-tetrahydrophthalic anhydride.

75. A method as recited in claim 74 wherein the carboxyl monomer is chosen from the group consisting of acrylic acid, maleic acid, itaconic acid, and maleic anhydride.

76. A method as recited in claim 1 wherein said phosphorus-containing carboxylate is a co-oligomer or copolymer obtained from the polymerization of two or more unsaturated monomers in the presence of a phosphorus containing compound, a major proportion of residues (more than 50% by weight) of the phosphorus-containing carboxylate being derived from carboxyl monomers which contain one or more carboxyl groups or which contain one or more groups that have been transformed after polymerization into carboxyl groups, the remaining residues being obtained from non-carboxyl monomers, and in which the resulting phosphorus-containing carboxylate contains phosphorus incorporations that are predominantly or exclusively present as dialkylphosphino species or the water soluble salts thereof.

77. A method as recited in claim 76 wherein the non-carboxyl monomers are selected from the group consisting of 2-acrylamido-2-methyloropanesulfonic, 2-hydroxy-3-(2-propenyloxy)propanesulfonic acid, 2-methyl-2-propene-1-sulfonic acid, allylsulfonic acid, allyloxybenzenesulfonic acid, styrenesulfonic acid, vinylsulfonic acid, allylphosphonic acid, vinylphosphonic acid, isopropenylphosphonic acid, phosphoethyl methacrylate, hydroxyalkyl and $C_1$–$C_4$ alkyl esters of acrylic or methacrylic acid, acrylamides, alkyl substituted acrylamides, allyl alcohol, 2-vinyl pyridine, 4-vinyl pyridine, N-vinylpyrrolidone, N-vinylformamide, N-vinylimidazole, vinyl acetate, hydrolyzed vinyl acetate, and styrene.

78. A method as recited in claim 76 wherein said carboxyl monomers are selected from the group consisting of acrylic acid, maleic acid, maleic anhydride, methacrylic acid, itaconic acid, crotonic acid, vinyl acetic acid, fumaric acid, citraconic acid, mesaconic acid, acrylonitrile, methacrylonitrile, alpha-methylene glutaric acid, cyclohexenedicarboxylic acid, cis-1,2,3,6-tetrahydrophthalic anhydride, 3,6-epoxy-1,2,3,6-tetrahydrophthalic anhydride, 5-norbomene-2,3-dicarboxylic anhydride, bicyclo[2.2.2]-5-octene-2,3-dicarboxylic anhydride, 3-methyl-1,2,6-tetrahydrophthalic anhydride, and 2-methyl-1,3,6-tetrahydrophthalic anhydride.

79. A method as recited in claim 78 wherein the carboxyl monomer is selected from the group consisting of acrylic acid, maleic acid, itaconic acid, and maleic anhydride.

80. A method as recited in claim 1 wherein said phosphorus-containing carboxylate is a co-oligomer or copolymer obtained from the polymerization of two or more unsaturated monomers in the presence of a phosphorus containing compound, a major proportion of residues (more than 50% by weight) of the phosphorus-containing carboxylate being derived from carboxyl monomers which contain one or more carboxyl groups or which contain one or more groups that have been transformed after polymerization into carboxyl groups, the remaining residues being obtained from non-carboxyl monomers, and in which the resulting phosphorus-containing carboxylate contains phosphorus incorporations, that are present as a mixture of phosphono, end-type phosphino, and dialkylphosphino species or the water soluble salts thereof.

81. A method as recited in claim 80 wherein the non-carboxyl monomers are selected from the group consisting of 2-acrylamido-2-methylpropanesulfonic, 2-hydroxy-3-(2-propenyloxy)propanesulfonic acid, 2-methyl-2-propene-1-sulfonic acid, allylsulfonic acid, allyloxybenzenesulfonic acid, styrenesulfonic acid, vinylsulfonic acid, allylphosphonic acid, vinylphosphonic acid, isopropenylphosphonic acid, phosphoethyl methacrylate, hydroxyalkyl esters of acrylic or methacrylic acid, $C_1$–$C_4$ alkyl esters of acrylic or methacrylic acid, acrylamides, alkyl substituted acrylamides, allyl alcohol, 2-vinyl pyridine, 4-vinyl pyridine, N-vinylpyrrolidone, N-vinylformamide, N-vinylimidazole, vinyl acetate, hydrolyzed vinyl acetate, and styrene.

82. A method as recited in claim 80 wherein said carboxyl monomers are chosen from the group consisting of acrylic acid, maleic acid, maleic anhydride, methacrylic acid, itaconic acid, crotonic acid, vinyl acetic acid, fumaric acid, citraconic acid, mesaconic acid, acrylonitrile, methacrylonitrile, alpha-methylene glutaric acid, cyclohexenedicarboxylic acid, cis-1,2,3,6-tetrahydrophthalic anhydride, 3,6-epoxy-1,2,3,6-tetrahydrophthalic anhydride, 5-norbomene-2,3-dicarboxylic anhydride, bicyclo[2.2.2]-5-octene-2,3-dicarboxylic anhydride, 3-methyl-1,2,6-tetrahydrophthalic anhydride, and 2-methyl-1,3,6-tetrahydrophthalic anhydride.

83. A method as recited in claim 82 wherein the carboxyl monomer is selected from the group consisting of acrylic acid, maleic acid, itaconic acid, and maleic anhydride.

84. A method as recited in claim 1 wherein said phosphorus-containing carboxylate is a phosphonic polymer having the generalized formula:

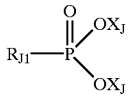

wherein $X_J$ is H, an alkali metal atom, an alkaline earth metal atom, or an ammonium or amine residue; and $R_{J1}$ is a copolymer residue comprising two different residues

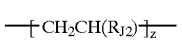

wherein z is an integer ranging from 2 to 100, and wherein, in the first residue, $R_{J2}$ is —COOH, and in the second residue, $R_{J2}$ is —$CONHC(CH_3)_2CH_2SO_3X_J$, wherein $X_J$ is as hereinbefore defined.

85. A method as recited in claim 1 wherein the aqueous system treatment material is a composition of up to 50% by weight of a phosphonosuccinic acid, based on the weight of the composition, a phosphonated dimer of alkali metal maleate, not more than a minor proportion by weight, based on the weight of the dimer, of higher phosphonated oligomers of maleate; and from 0.5 to 5% by weight of the composition of an alkali metal phosphate.

86. A method as recited in claim 1 wherein the long chain fatty acid derivative of a sarcosine is chosen to be N-Lauroylsarcosine or the water soluble salts thereof.

87. A method as recited in claim 1 wherein the composition includes water.

88. A method as recited in claim 1 wherein the composition additionally includes water.

89. A method as recited in claim 1 wherein said composition additionally contains at least one additive chosen from the group consisting of:

i. one or more dispersants ii. one or more copper corrosion inhibitors iii. one or more aluminum corrosion inhibitors iv. one or more water-soluble metal salts of metals chosen from the group zinc, manganese, aluminum, tin, nickel, yttrium, and the rare earth metals v. one or more water-soluble organic metal chelates of metals ions chosen from the group zinc, manganese, aluminum, tin, nickel, yttrium, and the rare earth metals, where the organic chelant is chosen to impart a desired level of water solubility of the metal ion vi. one or more scale control agents vii. one or more sequestering agents viii. one or more anti-foaming agents ix. one or more oxidizing biocides x. one or more non-oxidizing biocides xi. one or more water-soluble alcohols capable of lowering the freezing point of an aqueous system xii. one or more ionic freezing point depressants xiii. one or more pH adjusting agents xiv. one or more inert tracers xv. one or more active tracers xvi. one or more water insoluble organic lubricants xvii. one or more water soluble lubricants xviii. one or more surfactants xix. one or more calcium hardness adjusting agents xx. one or more coloring agents.

90. A method as recited in claim 89 wherein the composition additionally includes water.

91. A method as recited in claim 89 where the dispersant is a water-soluble sulfonated polymer or copolymer obtained from the polymerization of one or more ethylenically unsaturated monomers.

92. A method as recited in claim 91 where the water-soluble sulfonated copolymer is about a 3:1 weight ratio copolymer of acrylic acid and allyl hydroxy propyl sulfonate ether or the water soluble salts thereof.

93. A method as recited in claim 89 where the dispersant is a copolyrmier of diiosbutylene and maleic anhydride with molecular weight <10,000 or its water soluble salts.

94. A method as recited in claim 89 where the copper corrosion inhibitor is tolyltriazole.

95. A method as recited in claim 89 where the copper corrosion inhibitor is a mixed tolyltriazole composition including at least 65% of the 5-methyl benzotriazole isomer by weight.

96. A method as recited in claim 89 where the copper corrosion inhibitor is benzotriazole.

97. A method as recited in claim 89 where the copper corrosion inhibitor is mercaptobenzothiazole.

98. A method as, recited in claim 89 where the copper corrosion inhibitor is an alkyl or alkoxy substituted benzotriazole wherein the substitution occurs on the 4 or 5 position of the benzene ring.

99. A method as recited in claim 98 wherein the substitutent is chosen from the group consisting of nbutyl and hexyloxy.

100. A method as recited in claim 89 where the copper corrosion inhibitor is 1-phenyl-5-mercaptotetrazole.

101. A method as recited in claim 89 where the copper corrosion inhibitor is a halogen-tolerant azole.

102. A method as recited in claim 101 where the halogen-tolerant azole is chloro-tolyltriazole.

103. A method as recited in claim 89 where the aluminum corrosion inhibitor is a water-soluble nitrate salt.

104. A method as recited in claim 103 where the water-soluble nitrate salt is sodium nitrate.

105. A method as recited in claim 89 where the water-soluble metal salt is obtained from zinc.

106. A method as recited in claim 105 where the zinc salt is the sulfate, chloride, acetate, or nitrate salt.

107. A method as recited in claim 89 where the metal salt is obtained from manganese in the +2 oxidation state.

108. A method as recited in claim 107 where the manganese salt state is the sulfate, chloride, acetate, or nitrate salt.

109. A method as recited in claim 89 where the metal salt is obtained from lanthanum or a mixture of rare earth metals containing lanthanum.

110. A method as recited in claim 109 where the lanthanum salt or mixture of rare earth metal salts containing lanthanum are independently chosen from the sulfate, chloride, acetate, or nitrate salts.

111. A method as recited in claim 89 where the sequestering agent is selected from the group consisting of ethylenediaminetetra(acetic acid), nitrolotriacetic acid, and N,N-di(2-hydroxyethyl)glycine or the water soluble salts thereof.

112. A method as recited in claim 89 where the antifoaming agent is selected from the group consisting of silicones, polydimethylsiloxanes, distearylsebacamides, distearyladipamide, fatty alcohols, and ethylene oxide condensates of fatty alcohols.

113. A method as recited in claim 89 where the oxidizing biocide is selected from the group consisting of chorine, hypochlorite, bromine, hypobromite, chlorine donor compounds, bromine donor compounds, peracetic acid, inorganic peroxides and peroxide generators, chlorine dioxide, ozone and mixtures thereof.

114. A method as recited in claim 89 where the non-oxidizing biocide is selected from the group consisting of amines, quaternary ammonium compounds, 2-bromo-2-nitropropane-1,3-diol, β-bromonitrostyrene, dodecylguanidine hydrochloride, 2,2-dibromo-3-nitrilopropionamide, gluteraldhyde, chlorophenols, sulphones, methylene bis thiocyanates, methylene bis carbamates, isothiazolones, brominated propionamides, triazines, phosphonium compounds, organometallic compounds and mixtures thereof.

115. A method as recited in claim 89 where the non-oxidizing biocide is a mixture of (a) 2-bromo-2-nitropropane-1,3-diol (BNPD) and (b) a mixture of about 75% 5-chloro-2-methyl-4-isothiazolin-3-one and about 25% 2-methyl-4-isothiazolin-3-one, the weight ratio said BNPD (a) to said mixture (b) being about 16:1 to about 1:1.

116. A method as recited in claim 89 where the water-soluble alcohol freezing point depressant is selected from the group consisting of ethylene glycol, propylene glycol, ethanol, glycerol, isopropanol, and methanol, or mixtures thereof.

117. A method as recited in claim 89 where the ionic freezing point depressant is selected from the group consisting of calcium chloride, sodium chloride, lithium bromide, and lithium chloride.

118. A method as recited in claim 89 where the pH adjusting agent is selected from the group consisting of sodium hydroxide, potassium hydroxide, lithium hydroxide, hydrochloric acid, sulfuric acid, nitric acid, carbon dioxide, ammonia, organic acids such as oxalic acid, alkali metal carbonates, and alkali metal bicarbonates.

119. A method as recited in claim 89 where the inert tracer is selected from the group consisting of soluble lithium salts, transition metals, and fluorescent materials.

120. A method as recited in claim 89 where the active tracer is selected from the group consisting of fluorescently tagged polymers, polymers containing a photo-inert, latently detectable moiety, water soluble molybdate salts, and azole-based copper corrosion inhibitors.

121. A method as recited in claim 89 where the water insoluble organic lubricant is selected from the group consisting of naturally occurring oils and synthetic oils.

122. A method as recited in claim 89 where the surfactant is selected from the group consisting of anionic, cationic, amphoteric, and nonionic surfactants.

123. A method as recited in claim 89 where the calcium hardness adjusting agent is selected from the group consisting of the bicarbonate, carbonate, chloride, sulfate, and acetate salts of calcium, calcium hydroxide and calcium oxide.

124. A method as recited in claim 89 where the coloring agent is a water soluble dye.

125. A method as recited in claim 23 wherein the weight ratio of ortho-phosphate species to pyrophosphate species is in the range of about 20:1 to about 1:20, when both species are expressed as $PO_4^{-3}$.

126. A method according to claim 1 where the aqueous system is a cooling water system.

127. A method according to claim 126 where the cooling system is an open, evaporative cooling water system.

128. A method according to claim 126 where the cooling system is a once-through system.

129. A method according to claim 126 where the cooling system is closed loop cooling system.

130. A method according to claim 129 where the closed loop cooling system is the cooling system of an internal combustion engine.

131. A method according to claim 129 where the closed loop cooling system is a brine-based system which contains at least one additive selected from the group consisting of calcium chloride, lithium chloride, lithium bromide, and sodium chloride.

132. A method according to claim 129 where the closed loop cooling system is a system which contains at least one additive chosen from the group consisting of ethylene glycol, propylene glycol, ethanol, glycerol, isopropanol, and methanol.

133. A method according to claim 1 where the aqueous system is a hot water heating system.

134. A method according to claim 1 where the aqueous system is selected from the group consisting of pulping and papermaking systems, food and beverage systems, boiler systems, refinery systems, petrochemical processing systems, mining systems, and metal machining systems which utilize aqueous metal working fluids.

135. A method according to claim 1 where the aqueous system contains a fluid that is at least 5 percent by weight water.

136. A method according to claim 1 where the aqueous system contains a fluid that is at least 50 percent by weight water.

137. A method according to claim 1 where the aqueous system contains a fluid that is at least 90 percent by weight water.

138. A method according to claim 1 where the aqueous-.system contains dissolved oxygen.

139. A method according to claim 1 where the aqueous system is substantially or completely free of dissolved oxygen.

140. A method according to claim 1 where the aqueous system contains at least one dissolved gas chosen from group consisting of oxygen, carbon dioxide, hydrogen sulfide, and ammonia.

141. A method according to claim 1 where the aqueous system contains ferrous metal.

142. A method according to claim 141 where the ferrous metal is at least one metal selected from the group of cast iron, mild steel, low alloy steel, and stainless steel.

143. A method according to claim 1 where the aqueous system contains non-ferrous metal.

144. A method according to claim 1 where the non-ferrous metal is at least one metal selected from the group consisting of aluminum, copper, and the copper-based alloys.

145. A method according to claim 1 where the aqueous system contains both ferrous and non-ferrous metals.

146. A method according to claim 1 where the components are introduced into the system at an effective concentration by a slug feed.

147. A method according to claim 1 where the components are introduced into the system at an effective concentration to control corrosion by blending with the aqueous fluid as the system is being filled.

148. A method according to claim 1 where the components are fed into the system on a substantially continuous basis.

149. A method according to claim 1 where the components are fed into the system on an substantially intermittent basis.

150. A method according to claim 1 where the components are fed into the system using a combination of intermittent and continuous methods.

151. A method according to claim 1 where some of the components are fed into the system on a continuous basis and the remaining components are fed on an intermittent basis.

152. A method according to claim 1 where the method of feeding components into the system is selected from the group consisting of continuous feed at a fixed rate and feed based on a fixed time schedule.

153. A method according to claim 1 where components are introduced into the aqueous system at an effective concentration based on signals generated by an analog or computer-based feed control system.

154. A method according to claim 153 where the feed control system determines the feed rate based at least one of the following:

i) the concentration of one or more of the treatment components ii) the concentration of one or more inert or active tracer materials iii) the value of one or more measures of system performance iv) the value of one or more of the physical characteristics of the system v) the value of one or more chemical characteristics of the system.

155. A method according to claim 154 where the concentrations of treatment or tracer components is determined by at least one continuous, semi-continuous, or batch type analytical technique of the following types:

i) spectroscopic ii) electrochemical iii) chromatographic iv) methods that rely on antibody binding or release v) chemical based analytical methods.

156. A method according to claim 155 where the analytical technique is UV absorption spectroscopy.

157. A method according to claim 1 where components are introduced into the aqueous system at an effective concentration by a controlled release delivery system.

158. A method according to claim 1 where the combination of components is introduced into said aqueous system at a total concentration of about 0.5 to about 10,000 parts per million by weight.

159. A method according to claim 1 where the combination of components is introduced into said aqueous system at a total concentration of about 10 to about 1,000 parts per million by weight.

160. A method according to claim 1 where the weight ratio of component b) to component a) is from about 20:1 to about 1:1.

161. A method according to claim 1 where the pH of said aqueous system is from about 6 to about 10.

162. A method for controlling corrosion, deposition, and scale in an aqueous system at a pH of about 5 to about 12 which comprises introducing into said system a combination of:

(a) a tetrazolium compound of the formula:

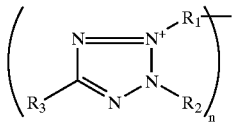

wherein $R_1$, $R_2$ and $R_3$ are selected from the group consisting of lower alkyl, branched lower alkyl, aryl, substituted aryl, alkylaryl, substituted alkyaryl and heterocyclic substituted aryl, with the proviso that neither $R_1$, $R_2$, or $R_3$ contain more than 14 carbon atoms; and n is 1 or 2, such tetrazolium compound optionally having associated water soluble ionic species if needed to obtain a neutral charge, and (b) at least one other aqueous system treatment material chosen so that the material does not substantially reduce the tetrazolium compound selected from the group consisting of inorganic phosphates; nitrites; compounds that release a metal anion in water; 2,3-dihydroxybenzoic acid; 1,10-phenanthroline; polycarboxylates; alkyl hydroxylcarboxylate acids; aminohydroxysuccinic acids; carboxyamines; polyepoxysuccinic acids; modified polyepoxysuccinic acids; monophosphonic acids; diphosphonic acids; phosphonocarboxylic acids; hydroxyphosphonocarboxylic acids; aminophosphonic acids; phosphonomethylamine oxides; polymeric amine oxides; polyetherpolyaminomethylene phosphonates; polyetherpolyamino-methylene phosphonate N-oxides; long chain fatty acids derivatives of sarcosine; telomeric, co-telomeric, polymeric or copolymeric phosphorus-containing carboxylates; amines; diamines; alkanolamines; fatty amines and diamines; quaternized amines; oxyalkylated amines; alkyl pyridines; benzoates; substituted benzoates; straight chain $C_5$–$C_{11}$ monocarboxylates; $C_4$–$C_{15}\alpha,\omega$-dicarboxylates; amine salts of carboxylic acids; mercaptocarboxylic acids; amino acids; polyamino acids; dicarboxylic acids; tricarboxylic acids; phosphoesters; phosphate esters; water soluble salts thereof and mixtures thereof, and additionally selected so that at least one of these treatments is effective in inhibiting scale and/or deposition, wherein the weight ratio of component (b) to component (a) is from about 100:1 to about 1:20.

* * * * *